US007427227B2

(12) United States Patent
Ooka

(10) Patent No.: US 7,427,227 B2
(45) Date of Patent: Sep. 23, 2008

(54) METHOD AND APPARATUS FOR FLUID POLISHING

(75) Inventor: Yasuhito Ooka, Anjo (JP)

(73) Assignee: DENSO Corporation, Kariya (JP)

( * ) Notice: Subject to any disclaimer, the term of this patent is extended or adjusted under 35 U.S.C. 154(b) by 144 days.

(21) Appl. No.: 11/509,749

(22) Filed: Aug. 24, 2006

(65) Prior Publication Data

US 2007/0049178 A1 Mar. 1, 2007

(30) Foreign Application Priority Data

Aug. 30, 2005 (JP) ..... 2005-249256
Sep. 20, 2005 (JP) ..... 2005-272176
Sep. 21, 2005 (JP) ..... 2005-273647

(51) Int. Cl.
*B24C 1/00* (2006.01)

(52) U.S. Cl. ..... 451/36; 451/8; 451/61; 451/104; 73/681.18

(58) Field of Classification Search ..... 451/1, 451/8, 36, 61, 64, 113, 104, 446; 73/681.18, 73/681.21, 681.356
See application file for complete search history.

(56) References Cited

U.S. PATENT DOCUMENTS 5,807,163 A 9/1998 Perry
6,132,482 A 10/2000 Perry
6,306,011 B1 10/2001 Perry et al.
6,319,094 B1 * 11/2001 Williams ..... 451/8
6,346,031 B1 * 2/2002 Lambert et al. ..... 451/36
6,500,050 B2 * 12/2002 Walch et al. ..... 451/36
2003/0166378 A1 * 9/2003 Fuksshimov et al. ..... 451/8

FOREIGN PATENT DOCUMENTS

DE 197 00 304 7/1998
DE 296 24 247 6/2001
JP 11-510437 A 9/1999
JP 2003-260653 9/2003
JP 2004-284014 A 10/2004
WO WO 01/15859 3/2001

OTHER PUBLICATIONS

Office Action dated Nov. 29, 2006 in German Application No. 10 2006 040 219.7-14 with English translation.

* cited by examiner

*Primary Examiner*—Lee D. Wilson
*Assistant Examiner*—Anthony Ojini
(74) *Attorney, Agent, or Firm*—Harness, Dickey & Pierce, PLC

(57) ABSTRACT

In a fluid polishing method for processing a fine aperture by slurry 7, the slurry is supplied from a cylinder 2*a* in a slurry flow rate target process until the flow rate increases to a target value of a slurry feed flow rate. When the flow rate reaches the target flow-rate, the cylinder is stopped and switched to another cylinder 2*b* and the operation fluid flow rate of the fine aperture is thereafter measured. In a metering process, to be executed next, a necessary processing time is calculated on the basis of the operation fluid flow rate and polishing is carried out for a necessary processing time by another cylinder 2*b*. Another cylinder is then stopped and switched and the operation fluid flow rate is measured. In this way, the metering process is repeated until the operation fluid flow rate reaches a predetermined value. In each process, the supply of the slurry is not interrupted.

10 Claims, 15 Drawing Sheets

Ks IS DETERMINED FROM GRADIENT OF APPROXIMATION STRAIGHT LINE (THICK LINE) DEFINED BY Q1, Q2, Q3 AND T1, T2

METHOD AND APPARATUS FOR FLUID POLISHING

BACKGROUND OF THE INVENTION

1. Field of the Invention

This invention relates to a fluid polishing method and a fluid polishing apparatus for executing the fluid polishing method. More particularly, the present invention relates to a method, and an apparatus for the method, for highly precisely processing a fine aperture by using a slurry of a polishing material.

2. Description of the Related Art

A large number of apparatuses exist that have a high precision fine aperture such as a nozzle tip of a fuel injector, a jet port of a carburetor, an orifice for regulating a fluid flow rate, a jet nozzle of a printer, and so forth. Methods for processing such a fine aperture include methods which employ laser, electron beam and discharge processing. There is the case where fluid polishing is employed when sufficient precision cannot be achieved by such methods. An example of the use of the fluid polishing method is a processing of a fine aperture of an orifice of a fuel injector for a diesel engine common rail. A common rail construction has recently been employed for diesel engines, and the diesel engines have been mounted to a variety of automobiles ranging from compact cars having an output of about 80 kW to large-scale trucks. However, fuel efficiency drops, and this adversely affects the economy, if any flow rate error occurs in the fuel injector. At the same time, pollutants of the environment increase undesirably in the exhaust gas and this is not desirable.

The flow rate error of the diesel engine common rail injector is greatly affected by the accuracy of the static oil flow rate of the orifice, as one of its constituent components, and a metering processing has been carried out by fluid polishing. Fluid polishing is carried out by causing a slurry (mixture of abrasives and an oil), discharged from a cylinder by the movement of a piston, to flow through the orifice to enlarge the diameter and to form an inlet R. However, there are cases where the oil flow rate greatly exceeds a target flow rate to thereby invite a defect, or is greatly smaller than the target flow rate and requires the repetition of fine adjustment.

The prior art technology has proposed a polishing method of a fine aperture of a nozzle of a diesel fuel injector (for example, Japanese Translation of PCT application 11-510437). A fluid polishing apparatus used for such a fluid polishing method includes a slurry tank and a cylinder for feeding the slurry.

The possibility of the occurrence of switching the cylinders, during the processing, exists in the fluid polishing method according to the prior art. In the fluid polishing apparatus, a piston of each cylinder moves back to suck the slurry from the tank after the slurry is used up. Because the suction time exists, the equipment has two cylinders so that as soon as the slurry of one of the cylinders is used up, the other cylinder is used. Nonetheless, the processing pressure cannot be kept constant at the instant of switching and a pressure fluctuation develops. If the pressure rises instantaneously, the flow rate apparently rises with reference to the relation $Q=A\cdot\sqrt{P}$ (A: constant, P: pressure) and reaches a target flow rate. Consequently, suitable processing is not carried out and the actual oil flow rate becomes smaller (see FIGS. 3 and 4). When the timing of switching of the cylinders occurs at the time that the flow rate is in the proximity of the target slurry flow rate (smaller by about 1 to 2 cc/min), the oil flow rate becomes large, on the contrary. As the processing capacity of fluid polishing is proportional to the pressure, the processing is promoted as the pressure becomes higher at the instant of switching and the processing that should originally be finished after a little time is excessively executed. As a result, the oil flow rate becomes larger (see FIG. 4). To solve this problem, it may be conceivable to drastically increase the cylinder capacity and to reduce the frequency of switching. When the cylinder capacity is increased, however, the slurry may be separated and the abrasives may precipitate inside the cylinder, so that variance occurs in the processing capacity and the precipitated abrasives are solidified and clog the cylinders.

SUMMARY OF THE INVENTION

In view of the problems described above, it is an object of the present invention to provide a fluid polishing method, and an apparatus for the method, capable of avoiding switching of cylinders during the fluid polishing and of improving the processing accuracy of a fine aperture by preventing the separation of the slurry and the precipitation of the abrasives.

The flow rate error of a diesel engine common rail injector is greatly affected by the static oil flow rate accuracy of the orifice as a constituent component of the injector and a metering processing is made by fluid polishing. Fluid polishing is carried out by causing a slurry (mixture of abrasives and oil) discharged from a cylinder, by the movement of a piston, to flow through the orifice to enlarge the diameter and to form an inlet R.

A processing capacity in this fluid polishing depends on the condition of the slurry and a processing pressure. The pressure is controlled to a constant level by the equipment but the slurry is degraded in the course of use due to wear of the abrasives and mixture of the metering oil, so that the processing capacity coefficient drops day by day. With the drop of the processing capacity coefficient, the processing accuracy is also deteriorated, and the processing time gets gradually longer, thereby extending the cycle time (CT) of one processing process (see FIG. 9).

Other prior art technologies are known that propose a fluid polishing method (Japanese Unexamined Patent Publication (Kokai) No. 2004-284014 and Japanese Translation of PCT Application No. 11-510437, for example) but these references do not disclose the proposal of the present invention.

The invention is completed under the circumstances described above and provides a fluid polishing method, and an apparatus for the method, capable of preventing the gradual increase of the processing time and the eventual extension of the cycle time owing to degradation with time of a slurry resulting from wear of the abrasives and mixture of the metering oil during fluid polishing.

A fluid polishing method according to the prior art generally involves the steps of causing the slurry to flow through the orifice until the slurry flow rate reaches a predetermined value set to be lower than a true target value, measuring the flow rate of oil (oil flow rate) as an operation fluid passing through the orifice at that time, deciding a further necessary processing time on the basis of insufficiency of the oil flow rate and conducting fluid polishing for the necessary processing time to finish the fine aperture of the orifice.

As a result, however, processing accuracy is deteriorated and variance in the oil flow rate becomes large. As a metering method, a method that determines a relation between an oil flow rate change amount and a processing time (which is called "processing capacity coefficient") from past statistic data, decides the processing time on the basis of this relation and conducts the processing has been proposed (for example, Japanese Unexamined Patent Publication (Kokai) No. 2004-284014). Because the processing capacity coefficient varies from work to work, however, variance occurs between the statistical value and an actual value and the estimation accuracy of the processing time is deteriorated with this variance, inviting a drop in processing accuracy.

According to the fluid polishing method that determines the processing time from the processing capacity coefficient, the processing time (T) is calculated from a difference (dQ) between a flow rate target value and a previous oil flow rate measurement value and a processing capacity coefficient (K) (that is, T=dQ/K). Here, the processing capacity coefficient is statistically decided from the past data by collecting a mean value of N times or a maximum value among N times as shown in FIG. 19. Because variance exists in practice from work to work, however, estimation accuracy of the processing time (T) is deteriorated owing to the difference between the statistic value and the actual value. Therefore, even when the processing is executed on the basis of this T value, the target oil flow rate cannot be reached. When the statistic value is smaller in comparison with the actual processing capacity coefficient, the processing time (T) is estimated to be a larger value, so that the target flow rate is exceeded and the operation becomes inferior. When the statistic value is larger than the actual value, on the contrary, the processing time (T) is estimated to be a smaller value. Though the target flow rate is not reached in this case, the target value can be achieved by conducting additional working. Therefore, at present, the processing capacity coefficient is estimated to a larger value than the actual value by adding a correction value a to the statistic value. However, when this procedure is employed, the processing time is always estimated as a smaller value and the target value cannot be easily reached. Consequently, the number of times of repetition increases and the total processing time inclusive of the measurement time also increases.

Another prior art technology proposes a fluid polishing method (for example, Japanese Translation of PCT Application No. 11-510437) but this reference does not disclose the proposal of the present invention.

Under the circumstances described above, the present invention aims at providing a fluid polishing method, and an apparatus for the method, capable of improving the processing accuracy of a fine aperture by improving the deterioration of a processing time by a method that estimates the processing time on the basis of a past statistical value of fluid polishing.

To accomplish the object described above, a first form of the invention provides a fluid polishing method for processing a fine aperture in a work (5) by supplying slurry (7) as a polishing fluid to the work (5), wherein the supply of the slurry (7) from the feeding apparatus (2*a*) is not stopped till a stop procedure.

According to this construction, processing can be carried out without stopping the slurry feeding apparatus in the fluid polishing process for supplying the slurry to the work. Therefore, temporary fluctuation of the slurry flow rate during processing can be prevented and processing accuracy of the fine aperture of the work can be improved.

In the second form of the invention, the apparatus includes a plurality of feeding apparatuses (2*a*; 2*b*), the feeding apparatuses (2*a*; 2*b*) are switched to other feeding apparatuses by a switching procedure after a stop procedure is executed, and the slurry is supplied to the work (5) by other feeding apparatuses. Because the feeding apparatuses (2*a*; 2*b*) are switched after a stop procedure, the feeding apparatuses (2*a*; 2*b*) are not operated in an intermediate stage and the supply of the slurry (7) is not stopped till the stop procedure.

According to this construction, it is possible to avoid the insertion of a switching operation of the slurry feeding apparatus into the fluid polishing process for supplying the slurry to the work. Therefore, it becomes possible to prevent a temporary fluctuation of the slurry flow rate during the processing and to improve the processing accuracy of the fine aperture of the work.

In the first form described above, the third form of the invention has a feature that the feeding apparatus (2*a*) is of a plunger type and has a cylinder (2*a*), the slurry (7) remaining inside the cylinder (2*a*) is completely returned to a slurry tank (1) while a work feeding apparatus such as a robot fits and removes the work to and from a jig, and the slurry (7) is again sucked so that this cylinder (2*a*) is filled substantially completely with the slurry (7).

According to this form of the invention, the processing time can be shortened by executing packing of the cylinder in parallel with the fitting or removal of the work and, because the slurry inside the cylinder is fully returned to the slurry tank, the separation of the slurry and the precipitation of the abrasives inside the cylinder can be prevented. This also contributes to the improvement of accuracy of processing the fine aperture of the work.

In the second form described above, the fourth form of the invention has a feature that the feeding apparatuses (2*a*, 2*b*) are of a plunger type and have a cylinder (2*a*, 2*b*), other feeding apparatus at rest completely returns the slurry (7) remaining inside the cylinders (2*a*, 2*b*) to the slurry tank (1) while the feeding apparatus in operation supplies the slurry to the work (5), and then again sucks the slurry (7) and substantially completely fills the cylinder (2*a*, 2*b*) with the slurry (7).

According to this form of the invention, as two sets of cylinders are alternately used, the processing time can be shortened by conducting filling of the cylinder in parallel with the processing and the slurry inside the cylinder that is switched and is at rest in the next processing step is fully returned to the slurry tank. As the separation of the slurry inside the cylinder and the precipitation of the abrasives can be prevented, this also contributes to an improvement in the processing accuracy of the fine aperture of the work.

In the third or fourth form described above, the fifth form of the invention has a feature that the capacity of each cylinder (2*a*, 2*b*) is at least 100 cc.

According to this form of the invention, it is possible to avoid the insertion of the cylinder switching operation into each process, of fluid polishing, that supplies the slurry to the work by using the cylinders having a sufficient capacity and to eventually improve the processing accuracy of the fine aperture of the work.

In any of the first to fifth forms described above, the sixth form of the invention has its feature in that the feeding pressure of the feeding apparatus (2*a*; 2*b*) is kept constant.

According to this form, polishing of the fine aperture can be carried out smoothly without any problem.

In the first to sixth forms described above, the seventh form of the invention has a feature that the work (5) is a fine aperture in a fuel injector for a diesel engine.

To accomplish the object described above, the eighth form of the invention provides a fluid polishing method for polishing and processing a fine aperture in a work (5) by supplying slurry (7) as a polishing fluid to the work (5), and this method includes at least one process. In this at least one process, the slurry (7) is caused to flow to the work for a predetermined processing time (T) and operation fluid flow rates (Q1, Q2) before and after processing are measured. In this fluid polishing method, a processing capacity coefficient (K) is determined on the basis of past data about a ratio (dQ/T) of an increment amount (dQ=Q2−Q1) of the operation fluid flow rates before and after processing for the processing time (T), and when the processing capacity coefficient (K) becomes less than a predetermined threshold value (a), a measure for improving the fluid polishing processing performance is taken.

According to this construction, degradation of slurry quality is detected as a change of the processing capacity coefficient (K). A threshold value is compared with the processing capacity coefficient and when the processing capacity coefficient becomes smaller than this threshold value, the fluid polishing performance is improved to cope with degradation and to prevent an increase in the processing cycle time (CT).

In the eighth form described above, the ninth form of the invention has a feature that the fluid flow rate is any of a slurry flow rate, an oil flow rate and an air flow rate.

This form discloses a form that embodies the operation fluid.

In the eighth or ninth form described above, the tenth form of the invention has a feature that the measure for improving the fluid polishing processing performance is a method that elevates the feed pressure of the slurry (7) from the feeding apparatus.

This form copes with slurry degradation by elevating the processing pressure and prevents an increase of the processing cycle time (CT).

In the eighth or ninth form described above, the eleventh form of the invention has a feature that the measure for improving the fluid polishing processing performance is the addition of new slurry (7).

According to this form, the addition of the slurry is carried out when the processing capacity coefficient becomes smaller than the threshold value and in this way, an increase of the processing cycle time (CT) can be prevented.

In any of the eighth to eleventh forms described above, the twelfth form of the invention has a feature that the processing capacity coefficient (K) is determined as a moving average ($\Sigma Kj/N$) of the processing capacity coefficients of a plurality of works, and a processing capacity coefficient (Kj) of each work is an average ($\Sigma Ki/M$) of a processing capacity coefficient (Ki) of each process of the work.

According to this form, a form for embodying the method for determining the processing capacity coefficient is disclosed.

In any of the eighth to eleventh forms described above, the thirteenth form of the invention has a feature that the processing capacity coefficient (K) is determined as a moving average ($\Sigma Kj/N$) of the processing capacity coefficients of a plurality of works, and a processing capacity coefficient (Kj) of each work is calculated by a mathematical extrapolation method using an operation fluid flow rate of each process of the work and three or more measurement values of the operation fluid flow rate of each process and the processing time corresponding to each operation fluid flow rate.

According to this form, a form for embodying the method for determining the processing capacity coefficient is disclosed.

In the thirteenth form described above, the fourteenth form of the invention has a feature that the mathematical extrapolation method is the method of least squares.

According to this form, a form for embodying the method for determining the processing capacity coefficient is disclosed.

In any of the eighth to fourteenth forms described above, the fifteenth form of the invention has a feature that a feed pressure of the slurry (7) from the feeding apparatus is kept constant during the processing of one work (5).

According to this form, polishing of the fine aperture can be carried out more smoothly and without any problem.

In any of the eighth to fifteenth forms described above, the sixteenth form of the invention has its feature in that the work (5) is a fine aperture of a fuel injector for a diesel engine.

To accomplish the object described above, the seventeenth form of the invention provides a fluid polishing method for polishing and processing a fine aperture in a work (5) by supplying slurry (7) as a polishing fluid to the work (5) by feeding apparatuses, including a primary processing process, a secondary processing process and a finishing process. In the primary process, a slurry feed flow rate is reliably limited to a low level and the slurry feeding apparatus is stopped in a processing stage in which the fine aperture is smaller than a target diameter. A first operation fluid flow rate (Q1) as the flow rate of the operation fluid flowing through the fine aperture at this time is measured. In the second process, a second processing time (T1) not reaching target processing is calculated on the basis of the first operation fluid flow rate (Q1), and the feeding apparatus is stopped after polishing is carried out for the second processing time (T1). A second operation fluid flow rate (Q2) as the flow rate of the operation fluid flowing through the fine aperture at this point is measured. In the finishing process, a target third processing time (T2) is calculated on the basis of the second operation fluid flow rate (Q2), and polishing is carried out for the third processing time (T2). Here, the processing time (T1, T2) in the secondary and finishing processes is determined by a processing capacity coefficient (K) and the processing capacity coefficient (K) is a function ($K=f(x)$, $x=dQ/T$) of a ratio ($dQ/T$) of an increment amount ($dQ$) of the operation fluid flow rate during processing to the processing time (T).

To improve the accuracy of the processing time by the method of estimating the processing time on the basis of the past statistical amount in fluid polishing, this construction calculates the processing capacity coefficient for each work or, in other words, calculates the processing capacity coefficient from the increment of the operation fluid flow rate and the processing time, accomplishes processing having higher accuracy by determined the processing time from the processing capacity coefficient, and improves the processing accuracy of the fine aperture of the work.

In the seventeenth form described above, the eighteenth form of the invention has a feature that the processing in the primary process is carried out by feeding the slurry (7) for a first processing time (T0) that is decided from data of past fluid polishing and is reliably smaller than a processing time necessary for processing the target fine aperture.

According to this construction, because the processing is carried out in the first process as the first stage of fluid polishing to a certain extent that reliably does not exceed the necessary processing amount. Consequently, excessive processing does not occur and efficient processing capable of reducing the processing time can be executed.

The initial stage of fluid polishing is an unstable region that is affected by the slurry condition and the work shape. In the nineteenth form of the present invention, therefore, the first processing time (T0) in the eighteenth form is a time exceeding the unstable region described above.

According to this form, processing is done in such a fashion as to exceed the initial stage as the unstable condition stage of fluid polishing in the primary process and consequently, the subsequent secondary process and finishing process become easier.

In any of the seventeenth to nineteenth forms described above, the twentieth form of the invention has a feature that the second processing time (T1) in said secondary process is calculated from a formula (1):

$$T1=(Qf-Q1)/\text{first processing capacity coefficient.}$$

Here, the first processing coefficient=mean processing capacity coefficient (K ave)+correction value (α), and Qf is a target operation fluid flow rate. The mean processing capacity coefficient (K ave) is a mean value of processing capacity coefficients (K) determined from past data of fluid polishing, and the correction value (α) is a value larger than one-way amplitude (3σ) of variance of the past data of the processing capacity coefficients (K).

This form discloses a concrete form of a method for deciding a suitable secondary processing time in the secondary process.

In the twentieth form described above, the twenty-first form of the invention has its feature in that the third processing time (T2) in the finishing process is calculated from equation (2):

$$T2=(Qf-Q2)/\text{second processing capacity coefficient } (Kw) \quad (2).$$

The second processing capacity coefficient (Kw) is calculated from equation (3):

$$Kw=(Q2-Q1)/T1 \quad (3).$$

This form discloses a concrete form of a method for deciding a suitable third processing time in the finishing process.

In any of the seventeenth to twenty-first forms described above, the twenty-second form of the invention has its feature in that the finishing process includes a first stage and a second stage. In the first stage, a third processing time (T2) not reaching a target processing is calculated on the basis of the second operation fluid flow rate (Q2), polishing is carried out for the third processing time (T2), and then the feeding apparatus is stopped. A third operation fluid flow rate (Q3) as the flow rate of the operation fluid flowing through the fine aperture at this point is measured. In the second stage, a target fourth processing time (T3) is calculated on the basis of the third operation fluid flow rate (Q3), polishing is carried out for the fourth processing time (T3) and then the feeding apparatus is stopped.

This form discloses a finishing process capable of reliably improving processing accuracy.

In the twenty-third and twenty-fourth forms described above, the twenty-second form described above, the third processing time (T2) is calculated from equation (4):

$$T2=(Q2-Q1)/\text{second processing coefficient } (Kw2).$$

Here, the second processing capacity coefficient=mean value of first processing capacity coefficients (K ave1)+correction value (β). The mean value of the first processing capacity coefficients (K ave1) is a mean value of the first processing capacity coefficients determined from past data of fluid polishing, and the correction value (β) is a value larger than one-way amplitude of variance of the past data of the first processing capacity coefficient. In the second stage, the fourth processing time (T3) is calculated by mathematical extrapolation, specifically the method of least squares, by using three measurement values formed from the first, second and third operation fluid flow rates (Q1, Q2, Q3) measured and from the first, second and third processing times (T0, T1, T2) corresponding to the respective flow rates.

According to the seventh and eighth forms, a method of deciding a suitable processing time in the finishing process is further embodied.

In any of the seventeenth to twenty-fourth forms described above, the twenty-fifth form of the invention has its feature in that the feed pressure of the slurry (7) from the feeding apparatus is kept constant.

According to this form, polishing of the fine aperture can be executed more smoothly and without a problem, by fluid polishing.

In any of the seventeenth to twenty-fifth forms described above, the twenty-sixth form of the invention has its feature in that the work (5) is a fine aperture of a fuel injector for a diesel engine.

This form further embodies the application of the present invention.

Incidentally, the reference numerals in parentheses, to denote the above means, are intended to show the relationship of the specific means which will be described later in an embodiment of the invention.

The present invention may be more fully understood from the description of preferred embodiments of the invention set forth below, together with the accompanying drawings.

DESCRIPTION OF THE PREFERRED EMBODIMENTS

A fluid polishing apparatus according to preferred embodiments of the invention will be hereinafter explained in detail with reference to the accompanying drawings.

Figure 1:
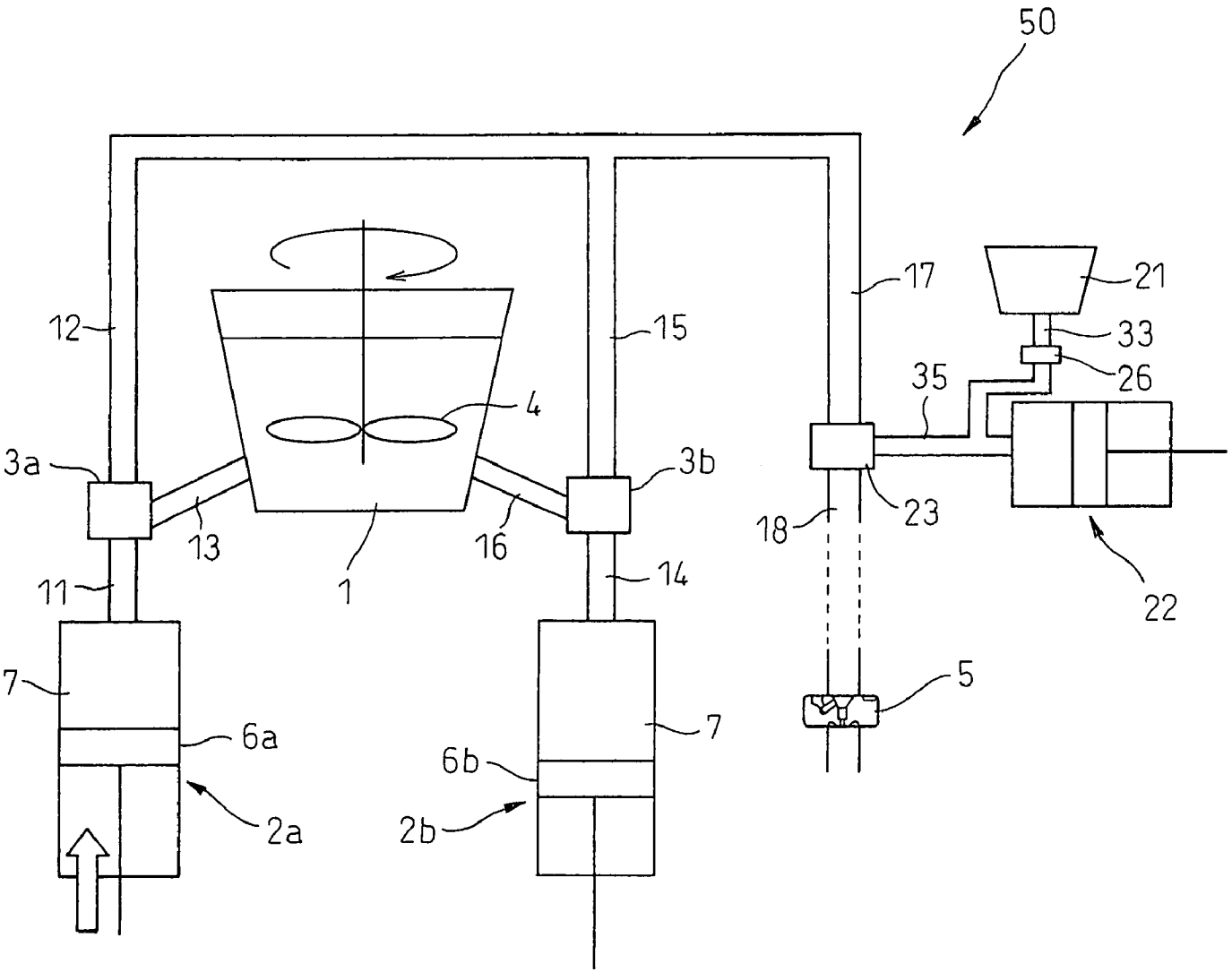
FIG. 1 is an explanatory view schematically showing a fluid polishing apparatus according to an embodiment of the present invention.
Figure 2:
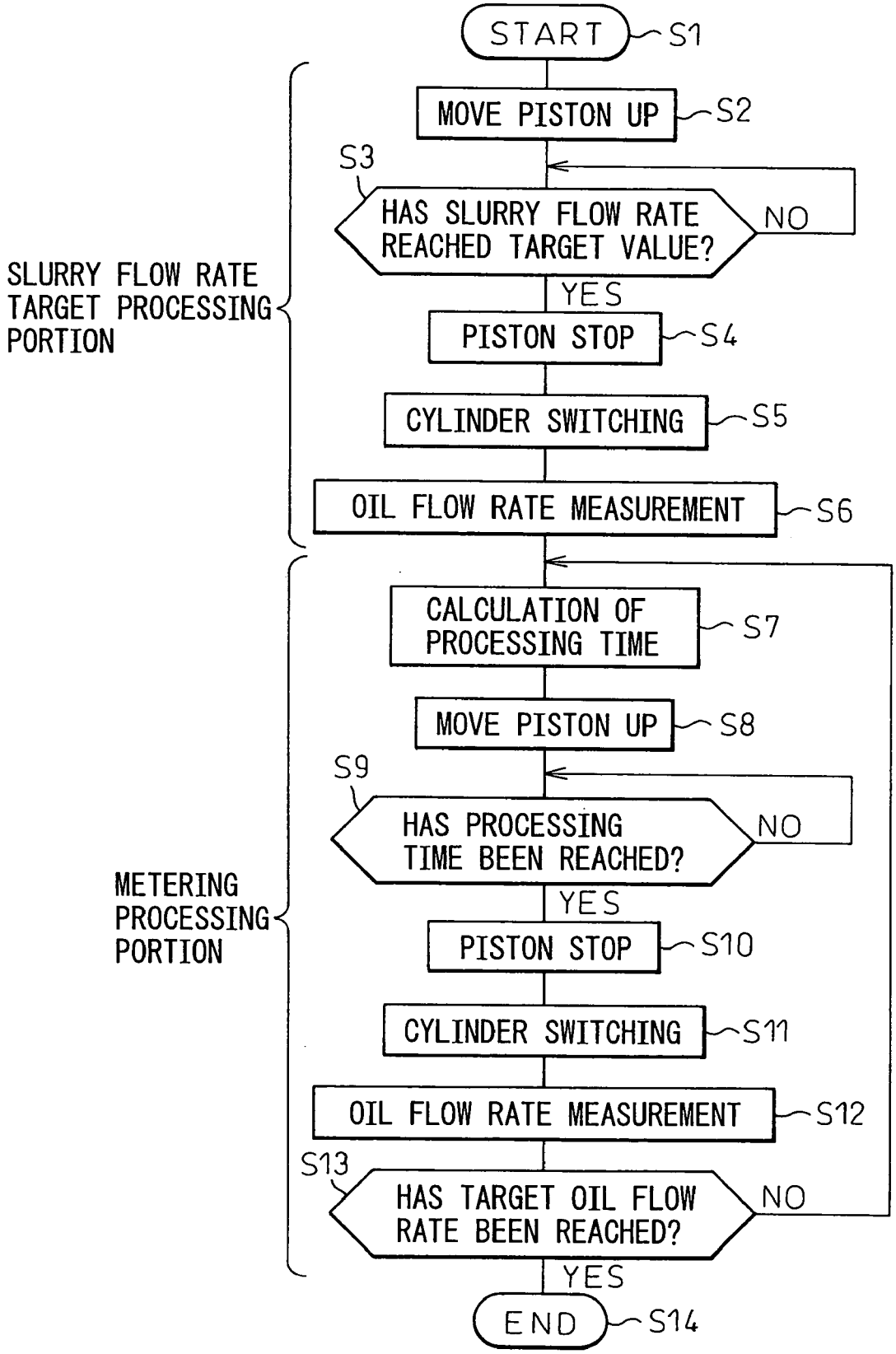
FIG. 2 is a flowchart for explaining a fluid polishing method according to an embodiment of the invention.
Figure 3:
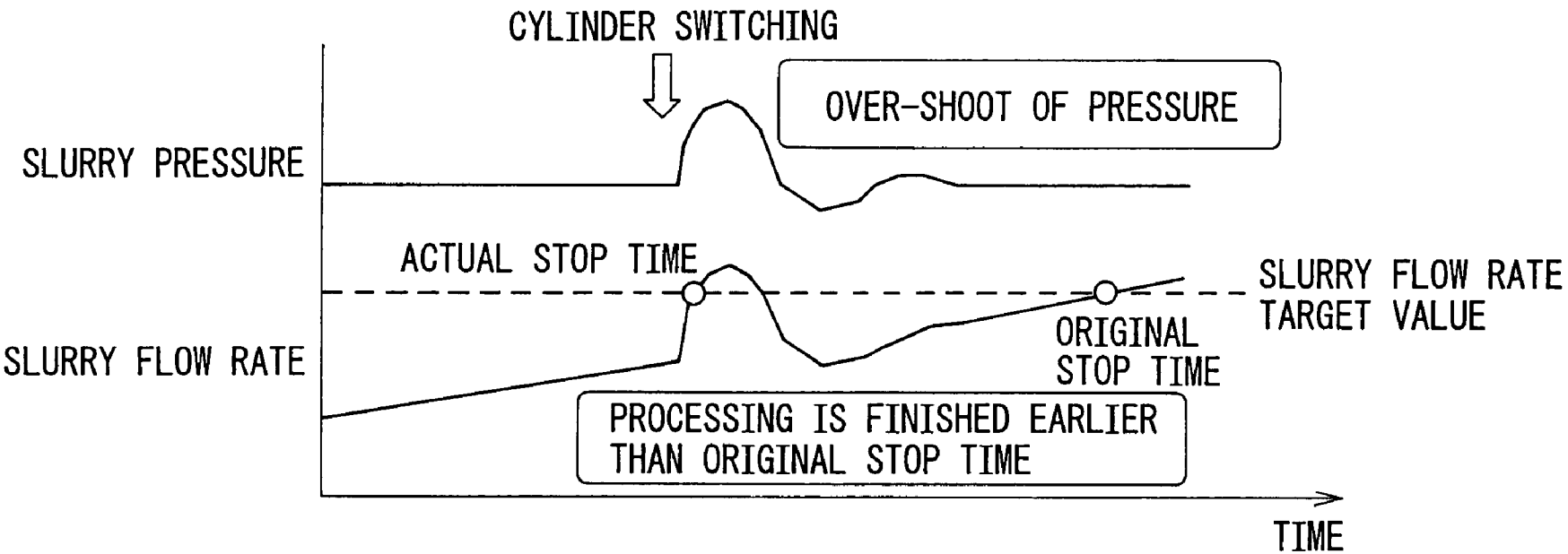
FIG. 3 is a graph showing the time change of a slurry pressure and a flow rate in a fluid polishing method according to a prior art example shown in FIG. 5.
Figure 4:
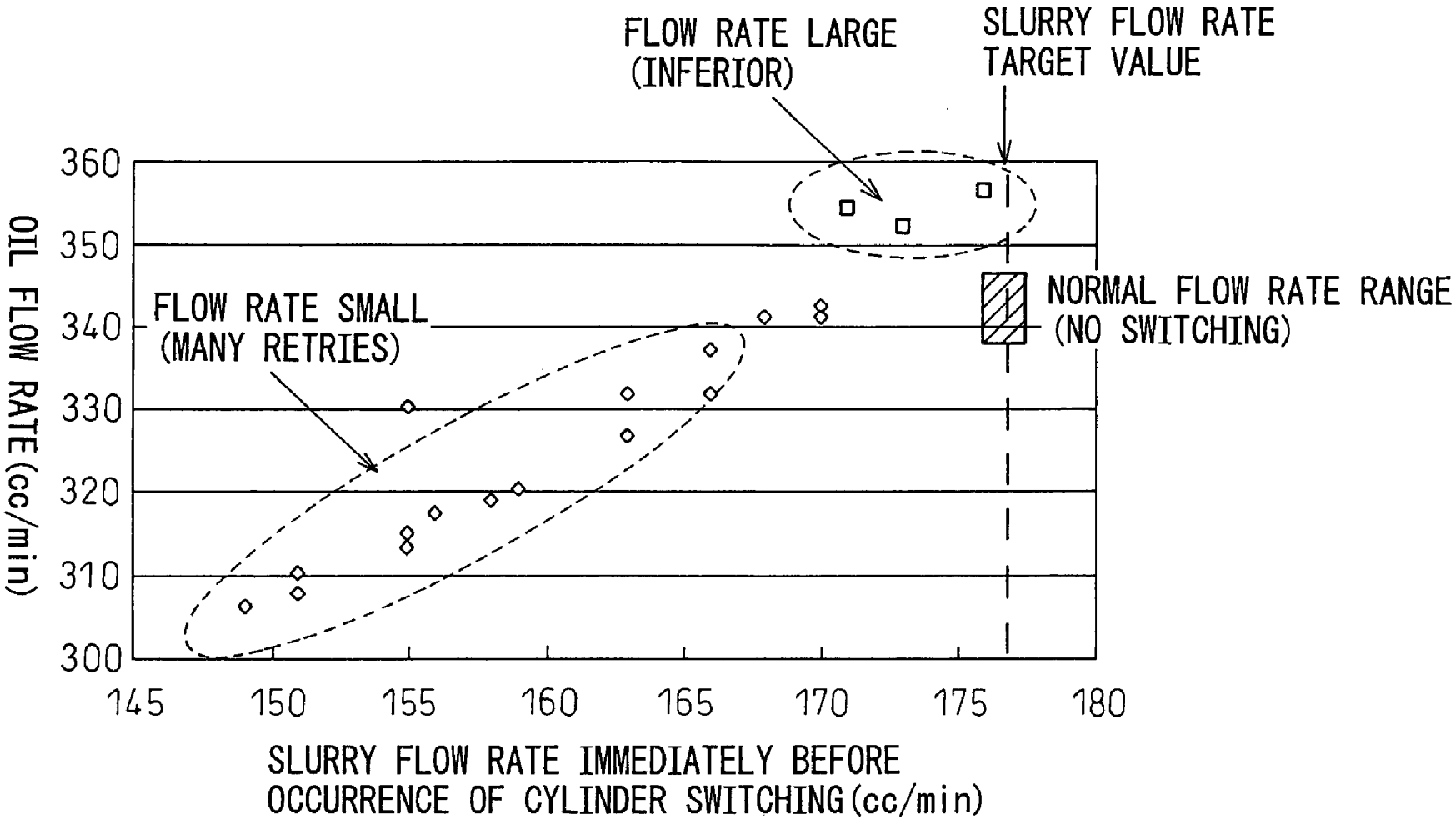
FIG. 4 is a graph showing the relation between a slurry flow rate immediately before cylinder switching and an oil flow rate at that time in a fluid polishing method according to a prior art, and also showing a comparison between a fluid polishing method according to the invention and a prior art example.

FIG. 1 is an explanatory view schematically showing a fluid polishing apparatus according to one embodiment of the invention and FIG. 2 is a flowchart for explaining a fluid polishing method according to an embodiment of the invention that uses the fluid polishing apparatus shown in FIG. 1.

To begin with, FIG. 1 shows a schematic construction of a fluid polishing apparatus 50 according to one embodiment of the invention. In this embodiment, the fluid polishing apparatus 50 is used for polishing a fine aperture of an orifice (work) 5 contained in a fuel injection device (ejector) of a diesel engine. The fluid polishing apparatus 50 has a slurry tank 1 for accommodating a polishing fluid (slurry) 7 containing a polishing material. A stirrer 4 is provided to the slurry tank 1. Separation and precipitation of the slurry 7 are prevented because the polishing fluid (slurry) 7 inside the slurry tank 1 is stirred by the stirrer 4. The fluid polishing apparatus 50 further has two sets of cylinders (feeding apparatuses) 2*a* and 2*b* each having a piston 6*a* and 6*b* and two sets of three-way valves 3*a* and 3*b*. The cylinders 2*a* and 2*b* are plunger type feeding apparatuses. The cylinders 2*a* and 2*b* are for discharging the slurry and two cylinders are provided to eliminate a suction time loss. For example, while one of the cylinders 2*a* discharges the slurry, the other cylinder 2*b* sucks the slurry and waits for the switching of the cylinders. Therefore, when the cylinder 2*a* is changed over, the slurry can be discharged without delay by the other cylinder 2*b*. These cylinders 2*a* and 2*b* preferably have a capacity of at least 100 cc (a capacity capable of achieving a flow rate 200 cc/min for at least 30 seconds). (This capacity corresponds to an injector orifice of a diesel engine of 80 kW or more).

In this way, when the cylinder 2*a* discharges the slurry to the orifice 5, the three-way valve 3*a* communicates piping 11 with piping 12 and closes an outlet port of piping 13. In this instance, the three-way valve 3*b* communicates piping 13 with piping 16 so that the cylinder 2*b* can suck the slurry 7 from the slurry tank 1, and an inlet port of the piping is closed. The three-way valve 3*a* communicates the piping 11 with the piping 13 at the time of switching of the cylinder described above and closes the inlet port of the piping 12. The three-way valve 3*b* communicates the piping 14 with the piping 15 and closes the outlet port of the piping 16. Therefore, the cylinder 2*b* can discharge the slurry 7 to the orifice 5 and the cylinder 2*a* can suck the slurry 7 from the slurry tank 1. The slurry 7 discharged from the cylinder is supplied to the orifice 5 to be processed from the piping 12 or 15 through the piping 17 and the piping 18.

The fluid polishing apparatus 50 includes an oil cylinder (operation fluid feeding apparatus) 22, an oil tank (fluidizing fluid tank) 21, a three-way valve 23 and a stop valve 26. The oil, kerosene in this case, is sucked from the oil tank 21 into the oil cylinder 22 through feed piping 23 and the stop valve 26 in the later-appearing flow rate measuring step, and the oil cylinder 22 feeds the oil into the orifice (work) 5 through the three-way valve 23 and the piping 18. In this instance, the three-way valve 23 is so set as to communicate the piping 25 with the piping 18 and to close the piping 17. When the slurry 7 is caused to flow to the orifice 5, the three-way valve 23 is so set as to communicate the piping 17 with the piping 18 and to close the piping 35. In this embodiment, the feeding apparatus of the oil is the plunger type oil cylinder 22 but another fluid feeding apparatus, such as a quantitative pump, may be used.

The polishing method according to one embodiment will be explained in further detail with reference to the flowchart of FIG. 2.

When a slurry flow rate target processing step (Step 2 (S2) to step 6 (S6) in FIG. 2) and a metering step (Step 7 (S7) to Step 13 (S13) are executed in this embodiment, the processing is started in Step 1 (S1) and the slurry flow rate target processing step is executed.

In Step 2 (S2), the piston 6*a* of the cylinder 2*a* moves up in the state where the three-way valve 3*a* communicates the piping 11 with the piping 12, and discharges the slurry 7 towards the orifice 5. To reach a predetermined discharge flow rate, the ascending speed of the piston 6*a* of the cylinder 2*a* is so controlled as to supply the slurry 7 at a constant discharge pressure. On the other hand, the piston 6*b* of the cylinder 2*b* moves down in the state where the three-way valve 3*b* communicates the piping 14 with the piping 16, and sucks the slurry 7 from the slurry tank 1. Next, the flow proceeds to Step 3 (S3) and whether or not the slurry flow rate reaches the target value is judged. When the flow rate does not reach the target value (NO), the piston 6*a* keeps moving up. On the other hand, the descending speed of the piston 6*b* for sucking the slurry is preferably constant and is sufficiently higher than the ascending speed of the piston 6*a* of the cylinder 2*a*. Generally, therefore, the piston 6*b* quickly reaches its lower end and the slurry 7 fills the inside of the cylinder 2*b*.

The ascending speed of the piston 6*a* becomes gradually higher as the processing hole becomes larger in size and, eventually, the slurry flow rate reaches the target value. In this instance, as a flag of arrival at the target value (YES) is set in Step 3, the flow proceeds to Step 4 (S4). In S4, the cylinder 2*a* is stopped and the flow proceeds to Step 5 (S5). As the three-way valves 3*a* and 3*b* are switched as described above, the cylinder is switched from 2*a* to 2*b*. The flow proceeds from S5 to Step 6 (S6). The three-way valve 23 is then switched and the oil (operation fluid) flow rate measurement is executed. In the measurement of the oil flow rate, the oil is caused to flow at a predetermined constant pressure and the oil flow rate in this case is measured. In Steps S5 and S6 after S4, the piston 6*b* of the cylinder 2*b* has already reached the lowermost end and the cylinder 2*b* has been filled with the slurry 7. The slurry 7 inside the cylinder 2*a* is returned to the slurry tank 1 as the piston 6*a* is moved up to the upper end.

After S6, the flow proceeds to the metering step. In Step 7 (S7), the necessary processing time subsequently required is calculated on the basis of the measured oil flow rate value. Next, the flow proceeds to Step 8 (S8). In S8, the piston 6*b* of the cylinder 2*b* moves up, preferably in such a fashion that the slurry discharge pressure becomes constant, and the fluid polishing step is advanced by causing the slurry 7 to flow towards the orifice (work) 5. In Step 9 (S9), whether or not the predetermined necessary processing time is reached is judged and the processing is continued by moving up, as such, the piston 6*b* when the judgment result is NO. The flow proceeds to Step 10 (S10) at the point at which the judgment result is YES. The cylinder 2*b* is stopped in S10. From S7 to S10, the piston 6*a* of the cylinder 2*a* is moved down at a higher speed than the ascending speed of the piston 6*b* on the basis of the calculated necessary processing time, to suck the slurry 7 from the slurry tank 1 and to fill the cylinder 2*a* with the slurry 7.

In Step 11 (S11), the three-way valves 3*a* and 3*b* are switched in the same way as cylinder switching of S5 to switch the cylinder from 2*b* to 2*a*. After S11, the residual slurry 7 inside the cylinder 2*b* is fully returned to the slurry tank 1 in the same way as in S5. In Step 12 (S12), the oil flow rate measurement is conducted by the same procedure and method as in S6 described above. In Step 13 (S13), whether or not the oil flow rate reaches the target value is judged. When the judgment result proves NO (when the flow rate does not reach the target value), the flow returns to S7 and the necessary processing time is again calculated. The steps S8 to S13 are repeated by using the cylinder 2*a*. This repetition is conducted until the oil flow rate finally reaches the target value. When the oil flow rate reaches the target value (YES) in S13, the flow proceeds to Step 14 (S14) and the processing is completed.

Next, the effects and operations of the embodiment described above will be explained.

The following effects can be expected from the fluid polishing method according to this embodiment and fluid polishing apparatus capable of executing the fluid polishing method.

In each step of fluid polishing for supplying the slurry to the orifice as the work by using the cylinders each having a sufficient capacity, the insertion of the cylinder switching operation during the processing can be avoided. Therefore, a temporary fluctuation of the slurry flow rate during the processing can be prevented and the processing accuracy of the fine aperture of the orifice can be improved.

The slurry inside the cylinder that is switched and enters the standby state in the next step is completely returned to the slurry tank. Therefore, the separation of the slurry and the precipitation of the abrasives inside the cylinder can be prevented and this effect also contributes to an improvement in the processing accuracy of the fine aperture of the orifice.

Figure 5:
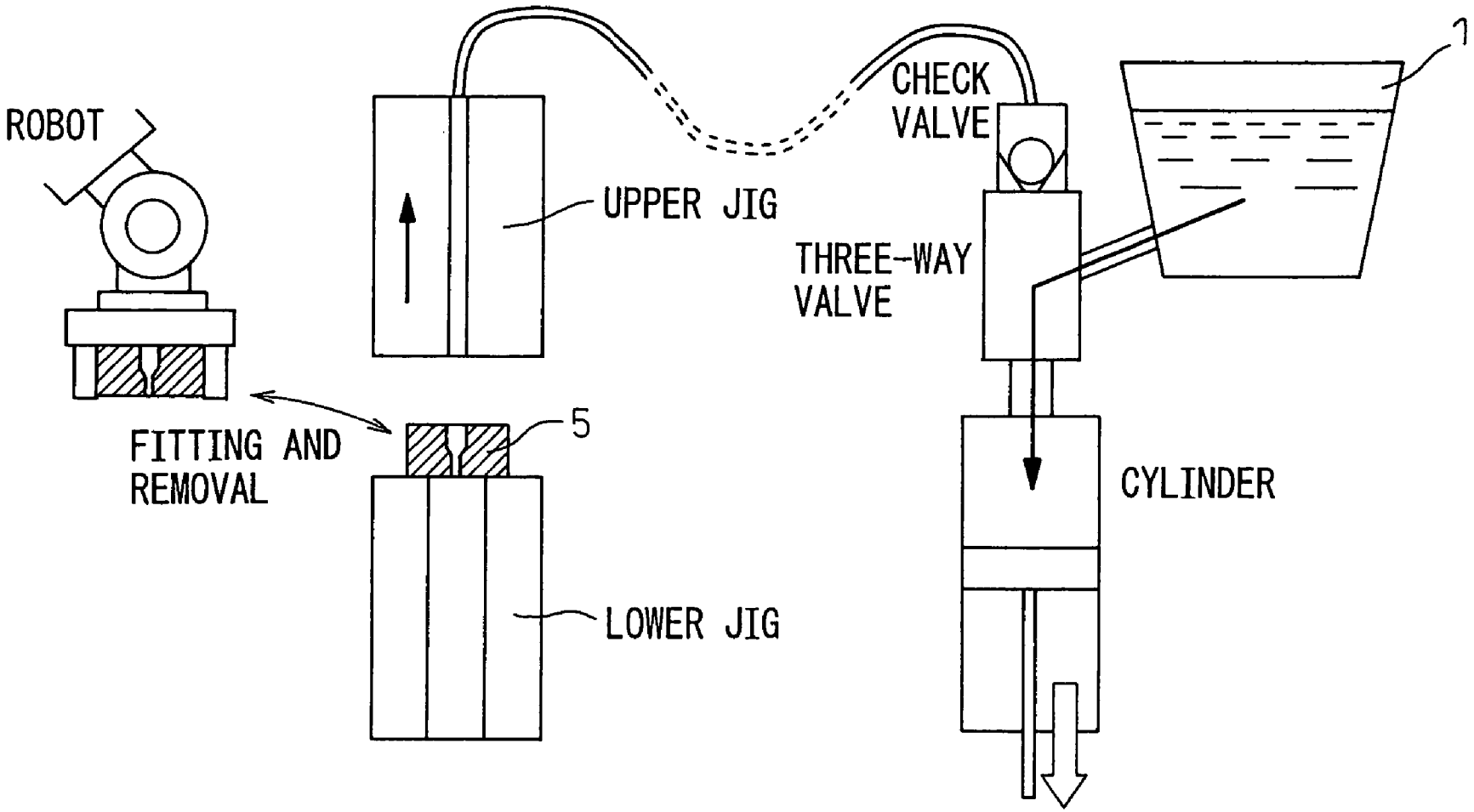
FIG. 5 is an explanatory view when a slurry is again packed into a cylinder when a work is fitted and removed in another embodiment.

Next, another embodiment of the invention will be explained. In the embodiment described above, the remaining slurry inside the cylinder 2*a* or 2*b* is returned to the slurry tank during the period from the stop of the cylinder (S4 or S10) to completion of the oil flow rate measurement (S6 or S12). The new slurry 7 is thereafter sucked from the slurry tank 1 to fully fill the cylinder to prepare for the next fluid polishing step. In another embodiment, in contrast, it is also possible to return the remaining slurry 7 inside the cylinder to the slurry tank 1 and to again suck the new slurry from the slurry tank 1 to fully fill the cylinder during the work fitting/removing step in which the work 5 is fitted and removed to and from the polishing portion (see FIG. 5). This work fitting/removing step is carried out between S14 and S1 in the flowchart shown in FIG. 2. The work fitting/removing step may also be carried out by using a robot or pick-and-press by an operator as shown in FIG. 5.

In this embodiment, too, effects similar to the effects described above can be acquired.

In the embodiments described above and in the embodiments shown in the accompanying drawings, the feeding apparatus for feeding the slurry to the work is the cylinder as a plunger type pump. However, the feeding apparatus may be various known pumps or fluid feeding apparatuses. Though two sets of slurry feeding apparatuses are provided above, the number of the feeding apparatus may be one or three or more sets. The three-way valve may be a combination of changeover valves.

Even when the cylinder as the slurry feeding apparatus is only one as described above, the replacement and refilling of the slurry are carried out during the cylinder stopping step (S4 or S10 in the embodiment described above) to the oil flow rate measuring step (S6 or S12 in the embodiment described above) or during the work fitting/removing step in another embodiment, and the fluid processing of one process can be executed without interruption of the processing. Thus, the effects of the present invention can similarly be accomplished. Incidentally, the flowchart of the fluid polishing process in this case is similar to the flowchart of the embodiment shown in FIG. 2 though the cylinder switching step is deleted.

This embodiment represents the case of processing of the orifice for the diesel engine common rail injector by way of example but the invention is not particularly limited thereto but may be applied to processing of other orifices or processing of fine apertures such as the distal end of the nozzle of the fuel injector, the jet port of the carburetor, the orifice for regulating the fluid flow rate, the jet nozzle of printers, and so forth, as described already.

Next, the second embodiment of the invention will be explained.

Figure 6:
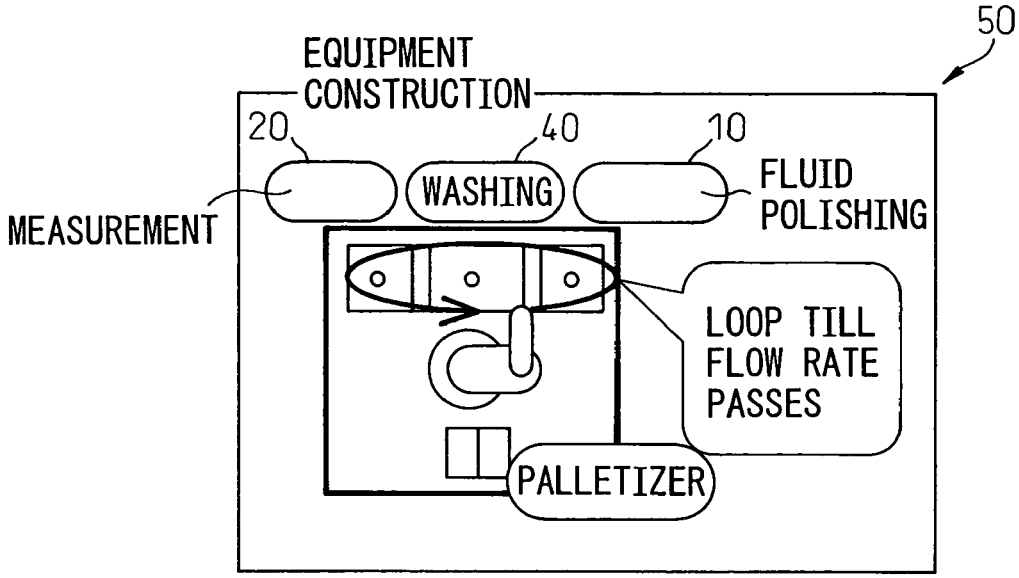
FIG. 6 is an explanatory view showing a schematic equipment construction of a fluid polishing apparatus according to an embodiment of the invention.
Figure 7:
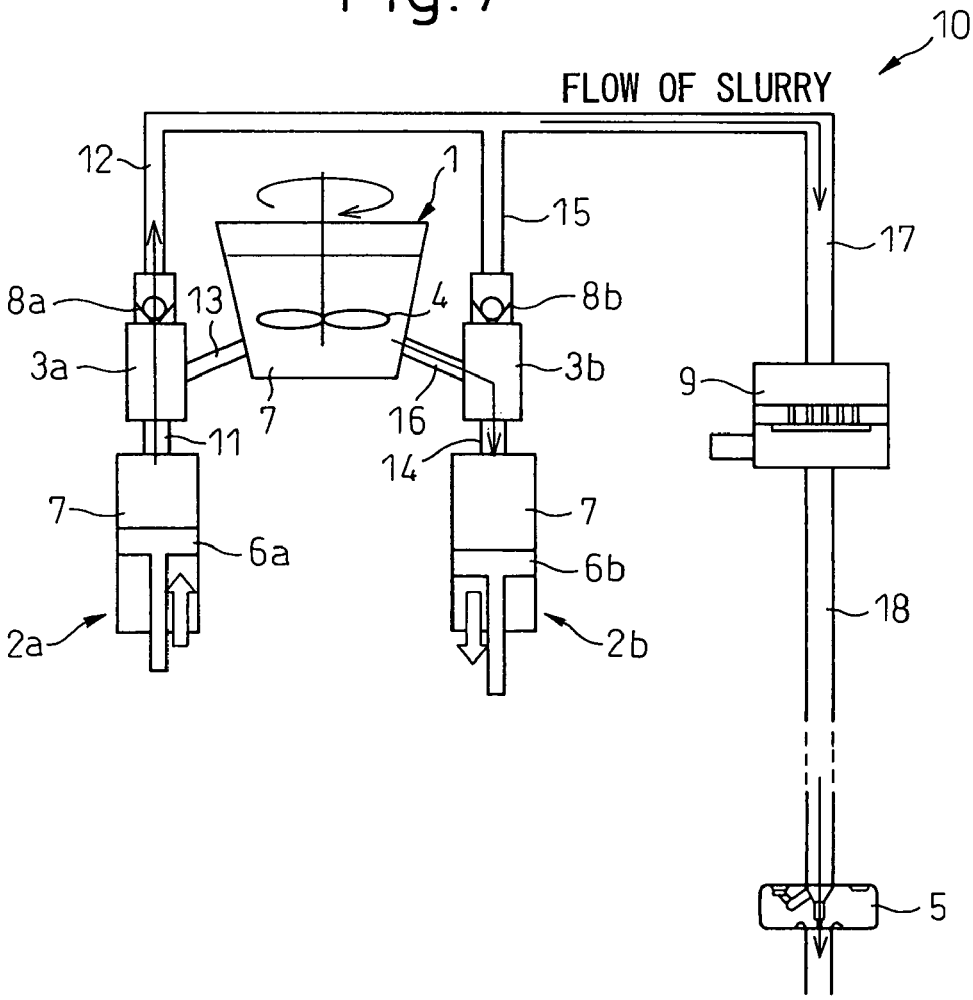
FIG. 7 is an explanatory view of a construction of a processing unit of the fluid polishing apparatus shown in FIG. 6.
Figure 8:
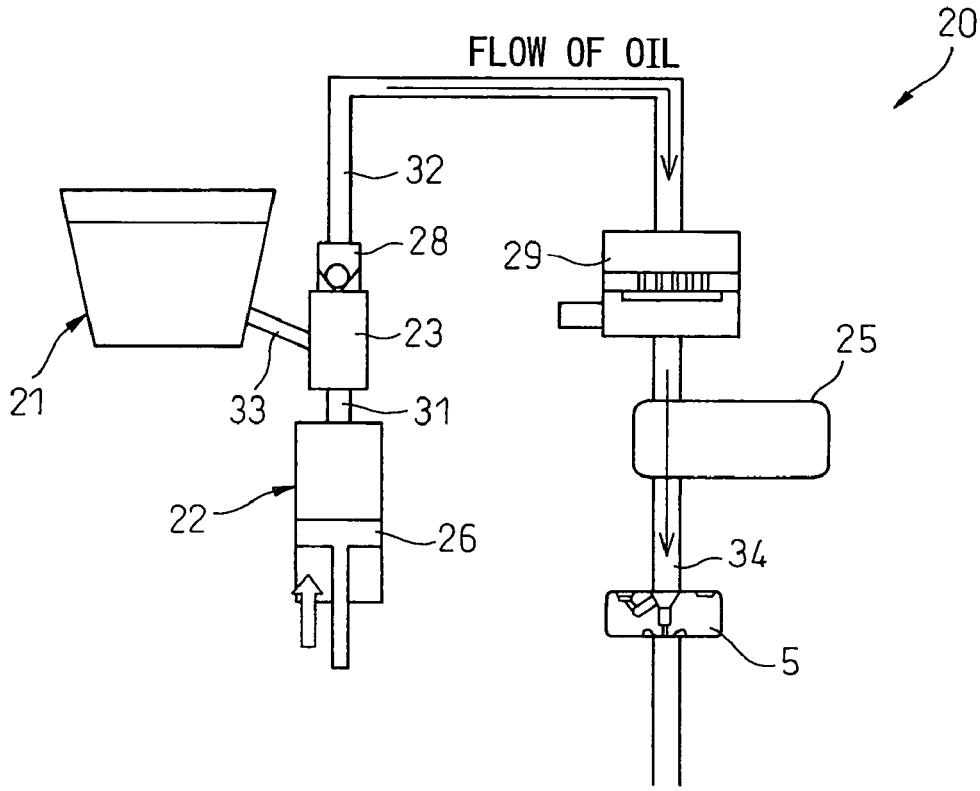
FIG. 8 is an explanatory view of a construction of a measuring unit of the fluid polishing apparatus shown in FIG. 6.

FIGS. 6 to 8 schematically show a fluid polishing apparatus according to this embodiment of the invention. FIG. 6 shows a schematic of the fluid polishing apparatus 50. FIG. 7 is an explanatory view for explaining the construction of a (fluid processing) processing unit 10 of the fluid polishing apparatus 50 shown in FIG. 6. FIG. 8 is an explanatory view for explaining the construction of an (oil flow rate) measuring unit 20 of the fluid polishing apparatus 50 shown in FIG. 6. In this embodiment, the work to be processed is an orifice of an injector (fuel injection device) for a diesel engine common rail and its fine aperture is subjected to fluid polishing by the fluid polishing apparatus 50.

Referring initially to FIG. 6, the fluid polishing apparatus 50 of this embodiment includes a (fluid polishing) processing unit (portion) 10, a measuring unit (portion) 20 of an oil flow rate and a washing unit (portion) 40.

The processing unit 10 causes a slurry 7 (processing medium: mixture of abrasives and oil) to flow to the orifice 5 as the work from a slurry feeding apparatus (slurry tank 1+cylinders 2*a* and 2*b*) to execute the processing. After the processing is complete, the work is washed by the washing portion 40. Next, the measuring unit 20 causes the oil as an operation fluid to flow from an oil feeding apparatus (oil tank 21+cylinder 22) to the orifice 5 and the flow rate at this time is measured by a flow rate meter 25. This cycle is repeated until a target oil flow rate is reached.

Next, FIG. 7 shows a schematic construction of a processing unit 10 inside the fluid polishing apparatus 50 shown in FIG. 6. The processing unit 10 includes a slurry tank 1 for accommodating the polishing fluid (slurry) 7 containing an abrasive material, and a stirrer 4 is provided to the slurry tank 1. As the slurry 7 inside the slurry tank 1 is stirred by the stirrer 4, separation and precipitation of the slurry 7 is prevented. The processing unit 10 further includes two cylinders (feeders) 2*a* and 2*b* each having a piston 6*a* and 6*b*, two sets of three-way valves 3*a* and 3*b* and check valves 8*a* and 8*b*. The cylinders 2*a* and 2*b* are plunger type feeders. The cylinders 2*a* and 2*b* are for discharging the slurry and two are provided in order to eliminate a loss of suction time. For example, while one of the cylinders 2*a* discharges the slurry, the other 2*b* sucks the slurry and enters the standby state until the cylinders are switched. When the cylinders are switched, therefore, the slurry 7 can be discharged by the other cylinder 2*b* without delay.

In this case, when the cylinder 2*a* discharges the slurry 7 to the orifice 5, the three-way valve 3*a* is so set as to communicate piping 11 with piping 12 and to close an outlet of piping 13. In order for the cylinder 2*b* to suck the slurry 7 from the slurry tank 1 in this instance, the three-way valve 3*b* is so set as to communicate piping 14 with piping 16 and to close an inlet of piping 15. At the time of switching of the cylinders described above, the three-way valve 3*a* is so set as to communicate the piping 11 with the piping 13 and to close the inlet of the piping 12 and the three-way valve 3*b* is so set as to communicate the piping 14 with the piping 15 and to close the outlet of the piping 16. Consequently, the cylinder 2*b* is able to discharge the slurry 7 to the orifice 5 and the cylinder 2*a* is able to suck the slurry 7 from the slurry tank 1. The slurry 7 discharged from the cylinder is supplied to the orifice 5 to be passed from the piping 12 or 15 through the piping 17 and 18. The check valves 8*a* and 8*b* prevent the backflow to the cylinders 2*a* and 2*b*, respectively.

An (oil flow rate) measuring unit 20 includes an oil cylinder (operation fluid feeding apparatus) 22, an oil tank (operation fluid tank) 21, a three-way valve 23 and a check valve 28. In a later-appearing oil flow rate measuring procedure, the oil (operation fluid) (kerosene in this case) is sucked from the oil tank 21 into the oil cylinder 22 through a feed piping 33, the three-way valve 23 and a piping 31. The oil cylinder 22 supplies the oil to the orifice (work) 5 through the piping 31, the three-way valve 23, the check valve 28, piping 32, a pressure sensor 29, a flow rate meter 25 and piping 34. In this instance, the three-way valve 23 is so set as to communicate the piping 31 with 32 and to close the piping 33. In this embodiment, the oil feeder is the plunger type oil cylinder 22 but another fluid feeder such as a quantitative pump may be used as well. The piping 34 may be connected to the piping 18 of the processing unit 10.

Next, for the fluid polishing apparatus 50 having the construction described above, an explanation will be given about the case where a fine aperture is processed in the orifice as the work by the fluid polishing method according to this embodiment of the invention. First, a pre-boring processing is applied to the orifice 5 by laser processing, or the like. The fluid polishing method according to this embodiment is thereafter carried out. The slurry 7 as the polishing fluid is supplied at a predetermined pressure from the cylinder 2*a*, for example, of the processing unit 10. In this case, a controller, not shown in the drawings, controls the cylinder 2*a* so that the pressure of the slurry 7 attains the predetermined pressure.

In this embodiment, a processing capacity coefficient (K) is set to decide a processing time (T). Fluid polishing is carried out for this processing time (T) to highly precisely finish a fine aperture having a predetermined size. The processing time (Ti) of one process is set to be shorter than the processing time necessary for processing the fine aperture having a predetermined size. Whenever one process is carried out, the actual operation fluid (oil: here, kerosene) is caused to flow through the fine aperture and the oil flow rate (Qi) is measured. The processing time (Ti+1) of the next step is determined on the basis of the oil flow rate (Qi) measured immediately before. A plurality of steps is carried out in this way and processing is done in such a fashion as to gradually finish the work to a fine aperture of the predetermined size.

The processing capacity coefficient (Ki) as the basis for calculating the processing time is decided by the change amount (dQi) of the oil flow rate (Qi) when fluid polishing is carried out for a certain processing time (Ti). In other words, the processing capacity coefficient: Ki=dQi/Ti.

In this embodiment, the change of quality of the slurry as the polishing fluid is grasped as the change of the processing capacity coefficient (K) of the slurry, and counter-measures are taken in accordance with the change of this processing capacity coefficient so as to maintain the efficiency of fluid polishing. The processing capacity coefficient becomes smaller with degradation of the quality of the slurry. Therefore, the processing time increases when a processing that generates the same oil flow rate change is carried out.

Figure 9:
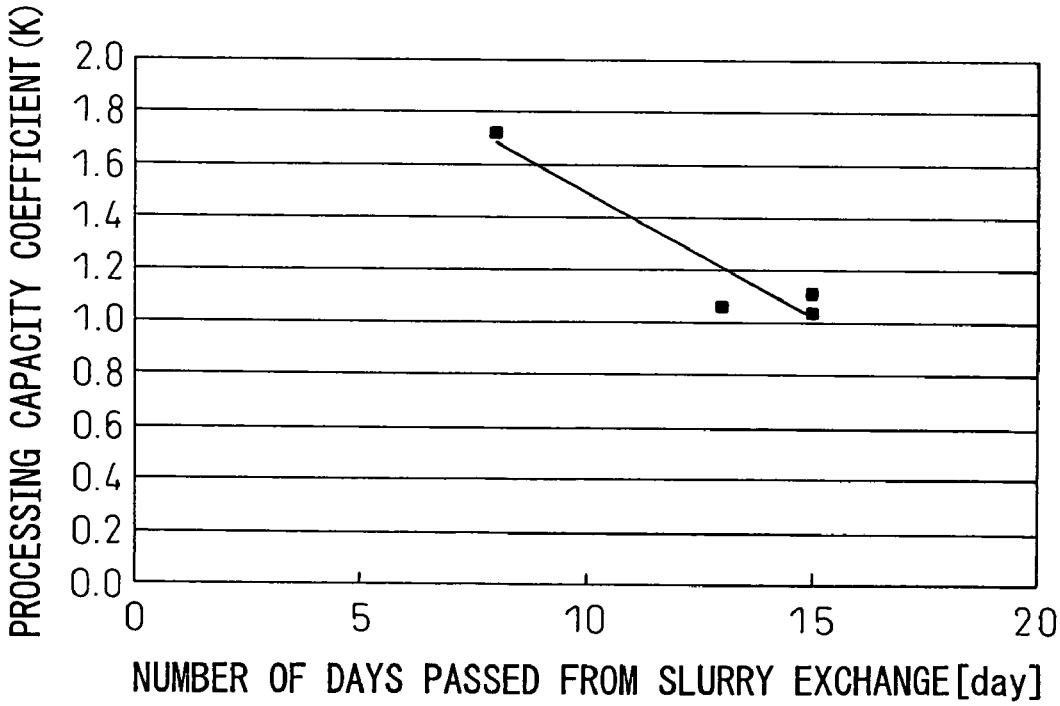
FIG. 9 is a graph showing data of the change with the number of days of a processing capacity coefficient in fluid polishing.

FIG. 9 shows the change of the processing capacity coefficient (K) due to fluidization (as the slurry is used for processing). The processing pressure is constant at each point plotted. As is obvious from this graph, the processing capacity coefficient (K) drops day by day. Here, the change of the processing capacity coefficient (K) is associated with processing energy. This processing energy W is expressed by $W=\alpha PQ$ (where $\alpha$ is a coefficient, P is a processing pressure and Q is a flow rate). The flow rate Q is expressed by $Q=CA\sqrt{(P/\rho)}$ (where C is a flow rate coefficient, A is an orifice sectional area and $\rho$ is a density). When the slurry becomes deteriorated (change of a blend ratio owing to wear of abrasives, mixture of oil, etc), $\alpha$ and $\rho$ change. In consequence, processing energy drops and the processing capacity coefficient decreases in accordance with the former.

Figure 10:
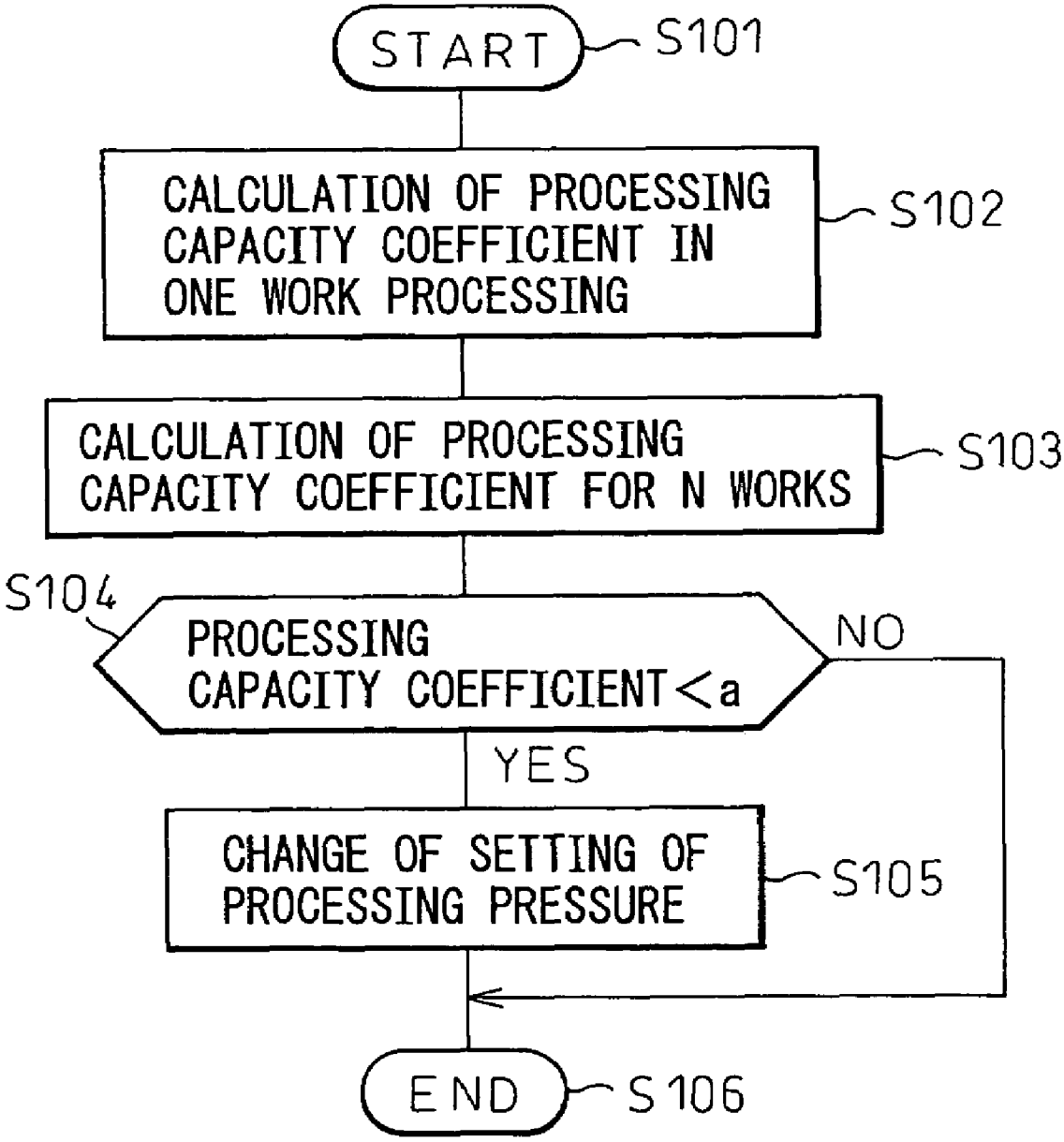
FIG. 10 is a flowchart of a slurry degradation prevention process in a fluid polishing method according to the second embodiment of the invention.

Because processing energy has a relation with the pressure, however, the processing capacity can be kept constant if the pressure is carefully controlled to match the decrease of the processing capacity coefficient. Alternatively, the processing capacity can be kept constant by conducting addition of slurry on the basis of the processing capacity coefficient and keeping $\alpha$ and $\rho$ constant. For example, when the processing capacity coefficient (K) is below a certain threshold value a as shown in the flowchart of FIG. 10, the addition of the slurry and the change of setting of the pressure are made. To achieve this procedure, however, it is necessary to detect the present processing capacity coefficient.

Figure 11:
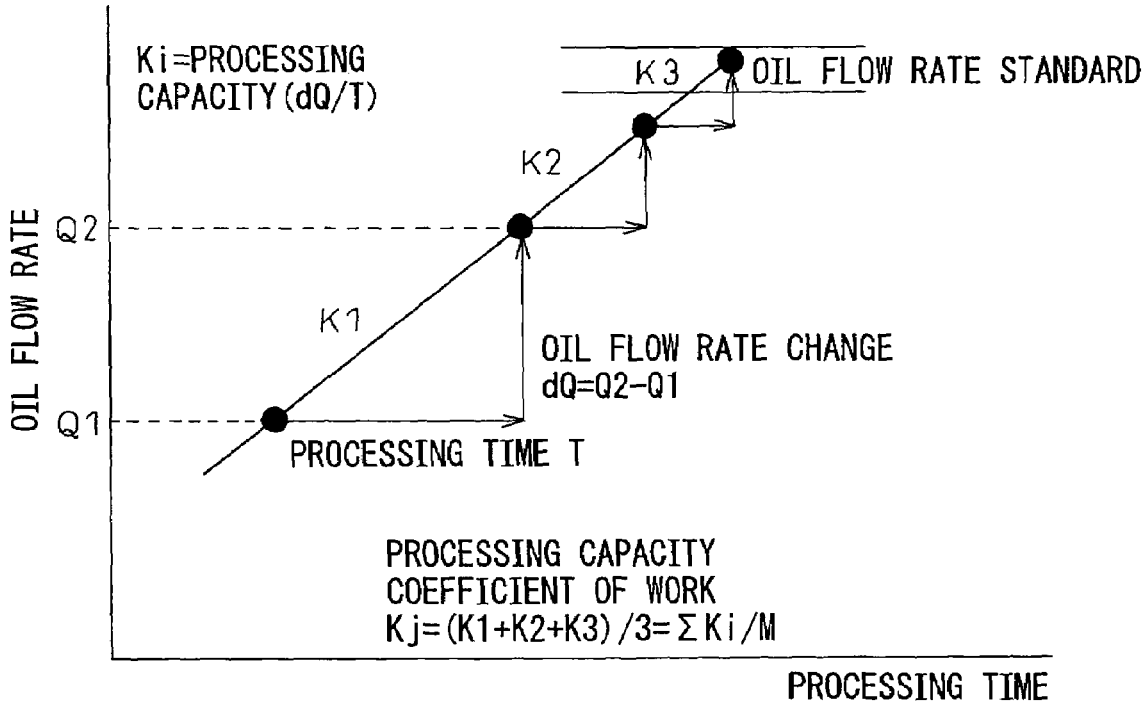
FIG. 11 is a graph for explaining a method of detecting a processing capacity coefficient in the fluid polishing method according to an embodiment of the invention.

Each work is subjected to retry processing until it falls within the oil flow rate standard. Therefore, the processing capacity coefficient (Ki=dQ/T) of the work is calculated from the oil flow rate change (dQ=Q2−Q1) before and after processing and the processing time (T) as shown in FIG. 11. Because the processing capacity coefficient can be calculated for each retry, it is averaged by the number of times of retries (M times) and the processing capacity coefficient of each work is determined ($\Sigma Kj-Ki/M$). Furthermore, because the processing capacity has a variance for each work, the processing capacities of N works is moved and averaged ($\Sigma Kj/N$) to more accurately detect the processing capacity.

The outline of the fluid polishing method according to this embodiment will be explained with reference to FIG. 11. For example, the oil as the operation fluid is allowed to flow to the fine aperture of the orifice 5 after a pre-boring step and a first oil (operation fluid) flow rate Q1 is measured. Fluid polishing of the first stage is then started. In this processing of the first stage, the first processing time T0 to the second oil flow rate Q2 smaller than the target oil flow rate Qf in the target fine aperture is determined (T0=(Q2−Q1)/K) by using the processing capacity coefficient K obtained on the basis of the past fluid polishing data. Fluid polishing is carried out for the first processing time TO in the first step processing. In this stage, the actual oil flow rate Q' is measured.

The subsequent processing steps are carried out in the same way as the first step described above. In the example shown in FIG. 11, the steps are executed three times and the processing is completed because the oil flow rate falls within the standard. In the example shown in FIG. 11, the oil flow rate Qi is measured at the end of each step. Because the processing time Ti in each step is known, the actual processing capacity coefficient Ki in each step can be calculated. Therefore, the average of the processing capacity coefficients of one work ($Kj=\Sigma Ki/M$) can be determined.

FIG. 10 shows a flowchart of the process of the counter-measure stage against degradation of the slurry in the fluid polishing method according to the second embodiment of the invention. When this process is started in Step 101 (S101), the processing capacity coefficient (Ki) in each step is calculated by fluid polishing a specific one of the works in Step 102 (S102) and the mean value (Kj) of the processing capacity coefficients is determined as described above (This is the processing capacity coefficient of this work). These values (Ki, Kj) are stored in the storage device. Next, in Step 103 (S103), the moving average ($\Sigma Kj/N$) of the processing capacity coefficient based on the data of N works by adding the data of the processing capacity coefficient of one work described above to the data of the processing capacity coefficients of N−1 works that are previously fluid-polished.

Next, in Step 104, whether or not the moving average described above becomes smaller than a predetermined threshold value (a) is examined. When it is smaller than the predetermined threshold value (a), the pressure setting is changed and increased. When it is larger than the predetermined threshold value (a), nothing is changed and the flow is as such finished (Step 106 (S106)) and processing of the next work is carried out with the same properties of the slurry and at the same discharge pressure.

Figure 12:
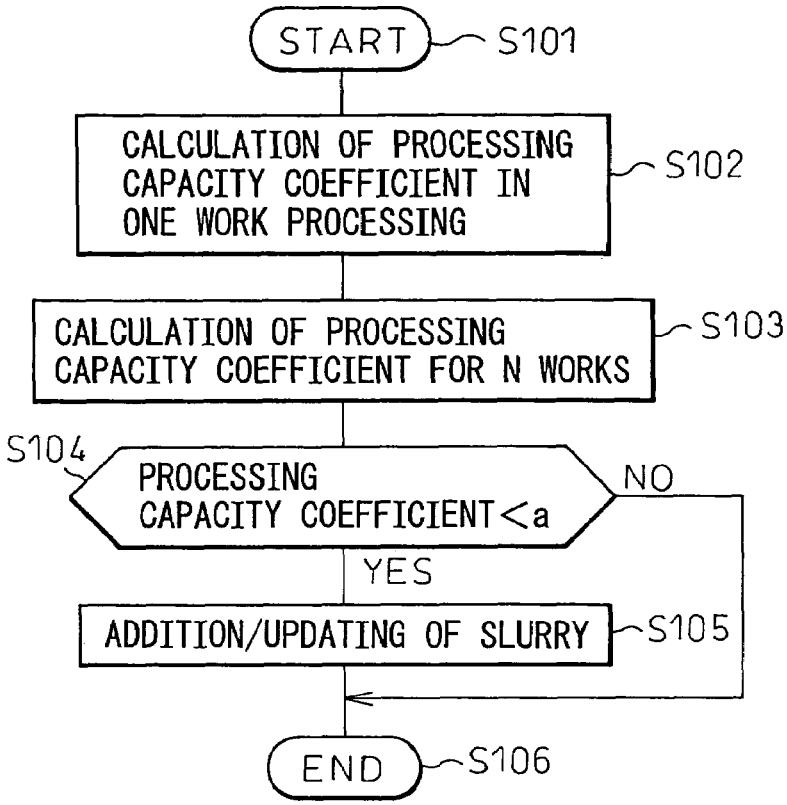
FIG. 12 is a flowchart of a slurry degradation prevention process in a fluid polishing method according to the third embodiment of the invention.

FIG. 12 shows the flowchart of the third embodiment of the present invention. In the third embodiment, the addition of the slurry is executed in place of the change of setting of the processing pressure in Step 105 of the flowchart of the second embodiment as the counter-measure by the improvement of quality of the slurry. As the rest of the procedures are the same as those of the second embodiment, a repetition of the explanation will be omitted.

The change of setting of the processing pressure and the addition/renewal of the slurry may be selectively used depending on the degree of quality degradation of the slurry. For example, it is permissible to execute the addition/renewal of the slurry depending on the level of the processing pressure and to renew the slurry depending on the number of times of addition of the slurry. The change of setting of the processing pressure and the addition/renewal of the slurry may thus be used selectively and appropriately depending on the conditions.

Next, the effects and operations of this embodiment will be explained.

The fluid polishing method and the apparatus for the method according to the second embodiment of the invention provide the following effects.

Degradation of slurry quality is detected as the change of the processing capacity coefficient, and the threshold value of this processing capacity coefficient is set. When the processing capacity coefficient becomes smaller than a threshold value, the processing pressure is elevated, as a counter-measure, to prevent an increase in the processing cycle time (CT).

The fluid polishing method and the apparatus for the method according to the third embodiment of the invention provide the following effects.

The addition of the slurry is executed when the processing capacity coefficient becomes smaller than the threshold value in the same way as in the second embodiment to prevent an increase in the processing cycle time (CT).

In the embodiments described above or shown in the accompanying drawings, the feeding apparatus for feeding the slurry to the orifice as the work is a cylinder of the plunger type pump but may be various known pumps or fluid feeding apparatuses besides a plunger type pump. Two or more feeding apparatuses may be provided though one feeding apparatus is shown in the embodiments described above.

Though the foregoing embodiments represent the application of the present invention to the processing of the orifice for the diesel engine common rail injector, the invention is not particularly limited thereto but may be applied to the processing of other orifices or the processing of fine apertures such as tips of the nozzle of fuel injection devices, jet ports of carburetors, orifices for regulating the flow rate of a fluid, jet nozzles of printers, and so forth.

Next, the fourth embodiment of the present invention will be explained.

Figure 13:
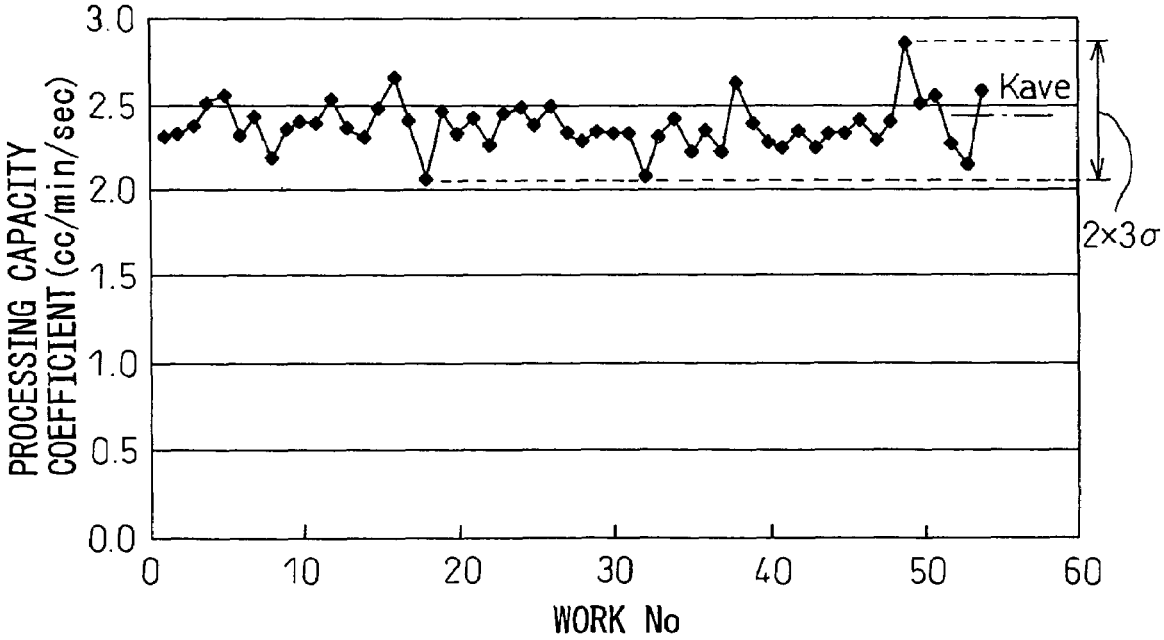
FIG. 13 is a graph showing data of a processing capacity coefficient in a work subjected to fluid polishing of the prior art.

To execute this embodiment, the processing time (T) is decided and the fluid polishing processing is carried out for this processing time (T). The processing time (T) has been determined in the past by the processing capacity coefficient (K) that is a statistical value as shown in FIG. 13.

Figure 15:
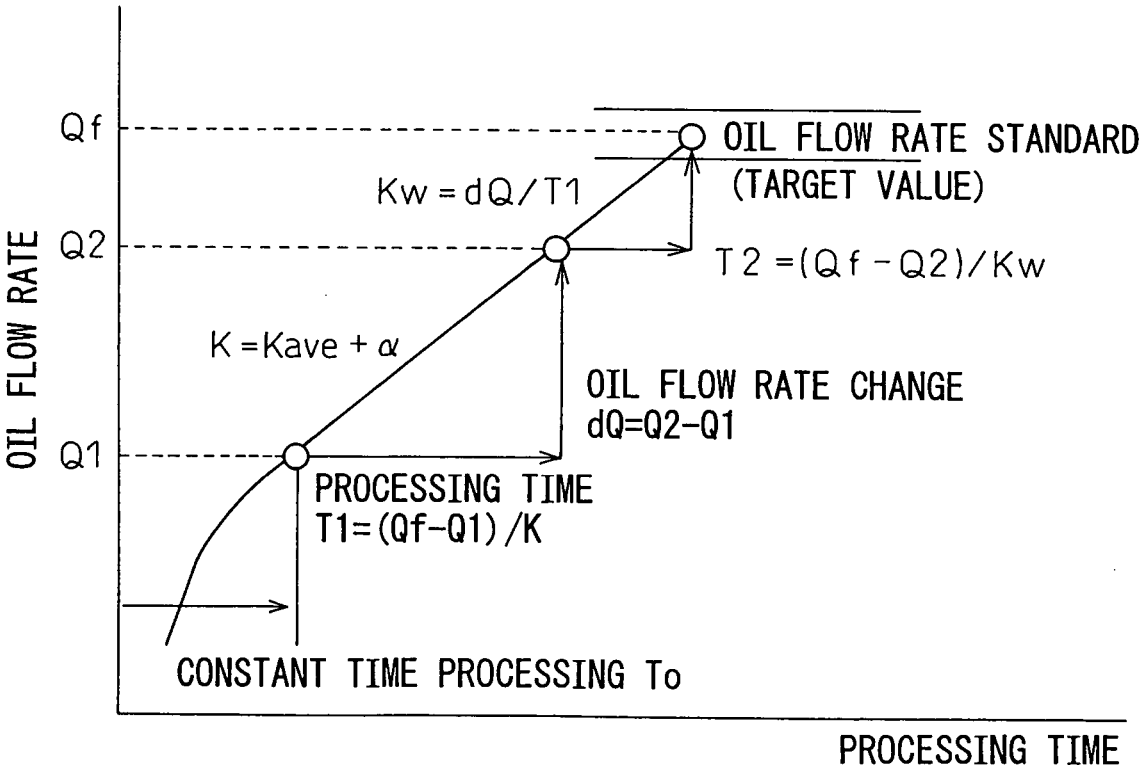
FIG. 15 is a graph showing the shift of an oil flow rate with a processing time in the fluid polishing method according to the fourth embodiment of the invention and also explaining a method of detecting a processing capacity coefficient.

The method of deciding the processing time in the fourth embodiment of the invention will be explained with reference to FIG. 15.

Figure 14:
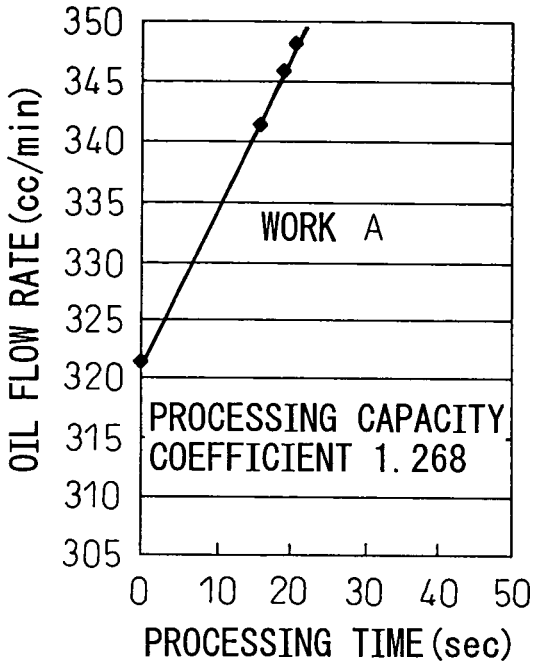
FIG. 14 is a graph for explaining the relation between an oil flow rate and a processing time in a fluid polishing method and also for explaining a processing capacity coefficient of a single work.

In fluid polishing processing, there is an unstable region in which the processing capacity coefficient (K) changes due to influences of the slurry condition and the work shape, in an initial stage of processing. However, it has been found, through experiment, that the processing capacity coefficient (K) becomes constant after processing is carried out for a certain predetermined time (first processing time (T0) inside the work and the processing capacity coefficient (K) is out of the unstable region (FIG. 14). This first processing time (T0) is the time when the time is out of (pass through) the unstable region but is a time in which the formation of the fine aperture, as the object, is not reliably-reached. In the processing for the first processing time (T0), the slurry supply flow rate increases to a value that is determined in advance and is smaller than the predetermined slurry flow rate necessary for processing the fine aperture as the object. Because the predetermined time T0 is different depending on the diameter of the pre-work aperture before polishing, etc, it is decided by prior processing tests. Alternatively, as the processing may well be carried out for a time exceeding the time T0, the slurry flow rate may be stopped at the slurry flow rate that brings the processing to the time longer than the time T0. After the processing is conducted for the predetermined time (T0), a correction value ($\alpha=3\sigma$) of variance approximate to one-way amplitude $3\sigma$ (see FIG. 13) is added to the mean value (K ave) of the N times of the processing capacity coefficients of the past works to obtain a provisional (first) processing capacity coefficient (K ave+$\alpha$). The second processing time (T1) is estimated on the basis of the first processing time ($T1=(Qf-Q1)/(K\ ave+\alpha)$). Here, Qf is the target oil (operation fluid) flow rate, that is, the oil flow rate when the processing is carried out normally. Because the provisional (first) processing capacity coefficient (K ave+$\alpha$) is sufficiently larger than the actual value, the target flow rate is not reached even when the processing is carried out. The second processing capacity coefficient of the work is detected (Kw=dQ/T1) from the change amount of the oil flow rate before and after processing (dQ=Q2−Q1) and the second processing time (T1). An optimal third processing time T2 is estimated (T2=(Qf−Q2/Kw) from the difference (Qf−Q2) between the second processing capacity coefficient (Kw) inherent to the work and the target value. Processing can be done very precisely by using this third processing time T2 and the target oil flow rate can be reached. As described above, the processing capacity coefficient (K) is calculated for each work and the processing time (T) is decided on the basis of the processing capacity coefficient (K).

Figure 16:
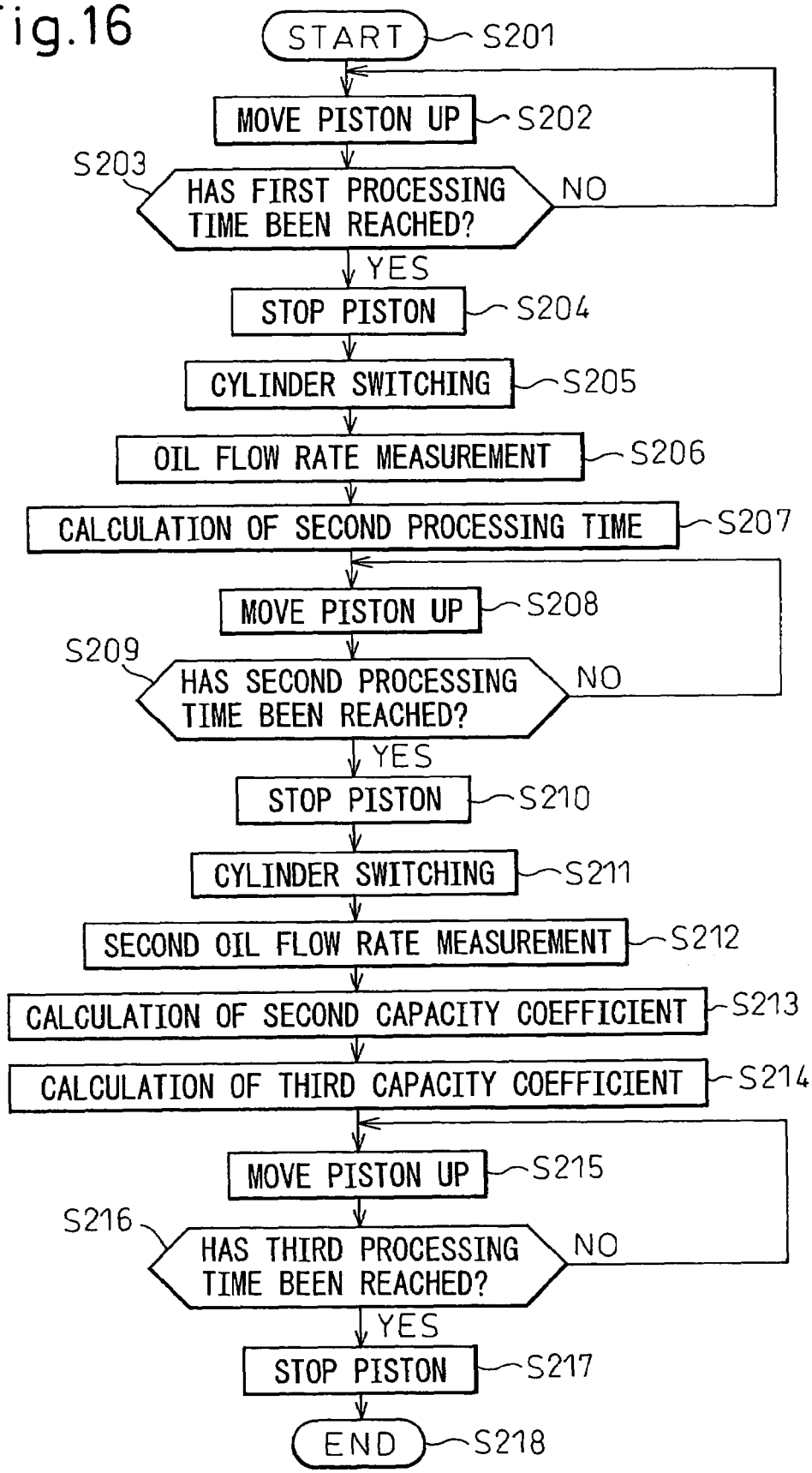
FIG. 16 is a flowchart of a fluid polishing method according to the fourth embodiment of the invention.

FIG. 16 shows a flowchart of the fluid polishing method according to the fourth embodiment of the invention. When the fluid polishing method of this embodiment is started in Step 201 (S201), a feeding apparatus such as the piston 6*a* of the cylinder 2*a* moves up in Step 202 (S202) and supplies the slurry 7 as the polishing fluid to the orifice 5, as the work, at a predetermined pressure. The fluid polishing processing is executed till the predetermined first processing time (T0) and when the first processing time (T0) is reached in Step 203 (S203), the piston 6*a* stops in Step 204 (S204). The cylinder is preferably switched from 2*a* to 2*b* in Step 205 (S205). It is preferred that, at the time of switching, the cylinder 2*b* completely returns the residual slurry remaining therein to the slurry tank 1 and again fully fills the tank with the slurry 7. Next, the first oil (operation fluid) flow rate is measured in Step 206 (S206) (this flow rate is called "Q1" in FIG. 15). The flow then proceeds to Step 207 (S207), in which the second processing time (T1) is calculated. This processing time is decided as described above by adding the correction value α to K ave on the basis of the mean value (K ave) of the processing capacity coefficients of the past data lest T1 becomes excessively large. Steps S201 to S206 correspond to the first processing steps.

In Step 208 (S208), the piston 6*b* of the cylinder 2*b* moves up as the cylinder is switched in S205 and the slurry 7 is supplied to the orifice 5. When the processing time reaches the second processing time T1 in Step 209 (S209), the flow proceeds to Step 210 (S210) and the cylinder 2*b* stops. In Step 211 (S211), the cylinder is preferably switched from 2*b* to 2*a* in the same way as in S205. The flow then proceeds to Step 212 (S212) and the second oil flow rate (Q2) is measured in S212. The steps from S07 to S212 correspond to the second processing step.

In Step 213 (S213), the second processing capacity coefficient (Kw) is calculated on the basis of Q1, Q2 and T1 as described above. In Step 214 (S214), the third processing time (T2) is calculated on the basis of Kw as described above. Subsequently, in Step 215 (S215), the piston 6*a* of the cylinder 2*a* moves up and supplies the slurry 7 to the orifice 5 to execute the polishing processing. In Step 216 (S216), whether or not the third processing time T2 is reached is checked. When T2 is reached, the piston 6*a* is stopped (Step 217 (S217)) and the processing is finished (Step 218 (S218)). The steps from S213 to S217 correspond to the finishing step.

Figure 17:
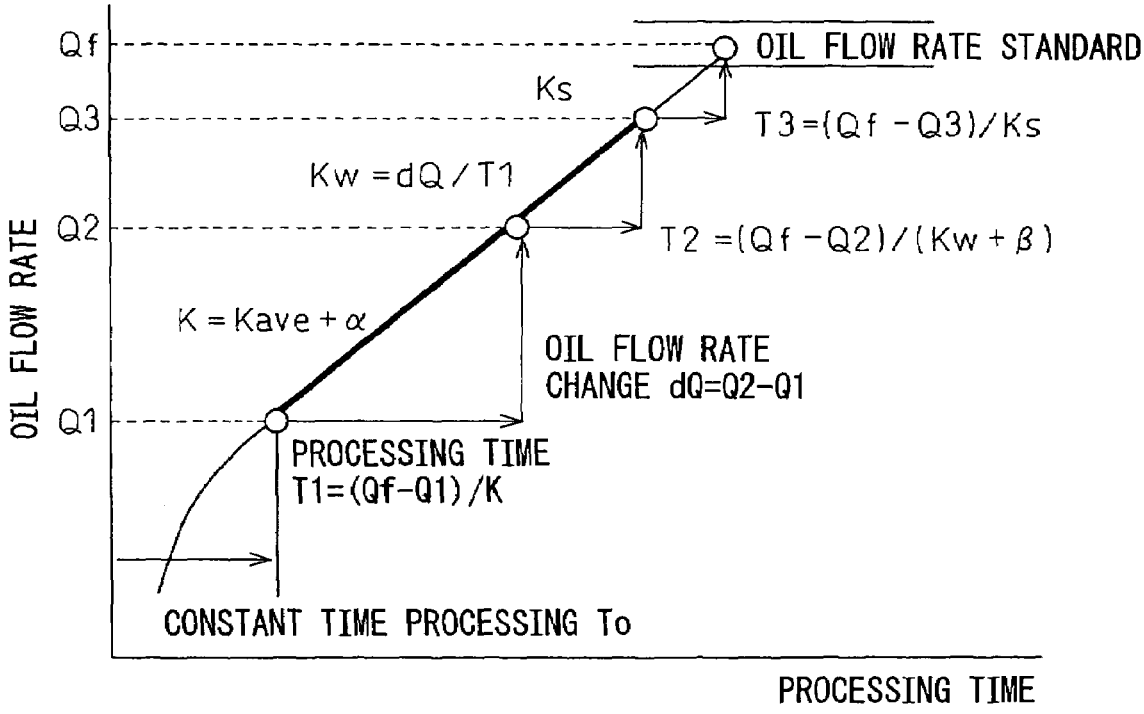
FIG. 17 is a graph showing the shift of an oil flow rate with a processing time in the fluid polishing method according to the fifth embodiment of the invention and explaining also a method of detecting a processing capacity coefficient.
Figure 18:
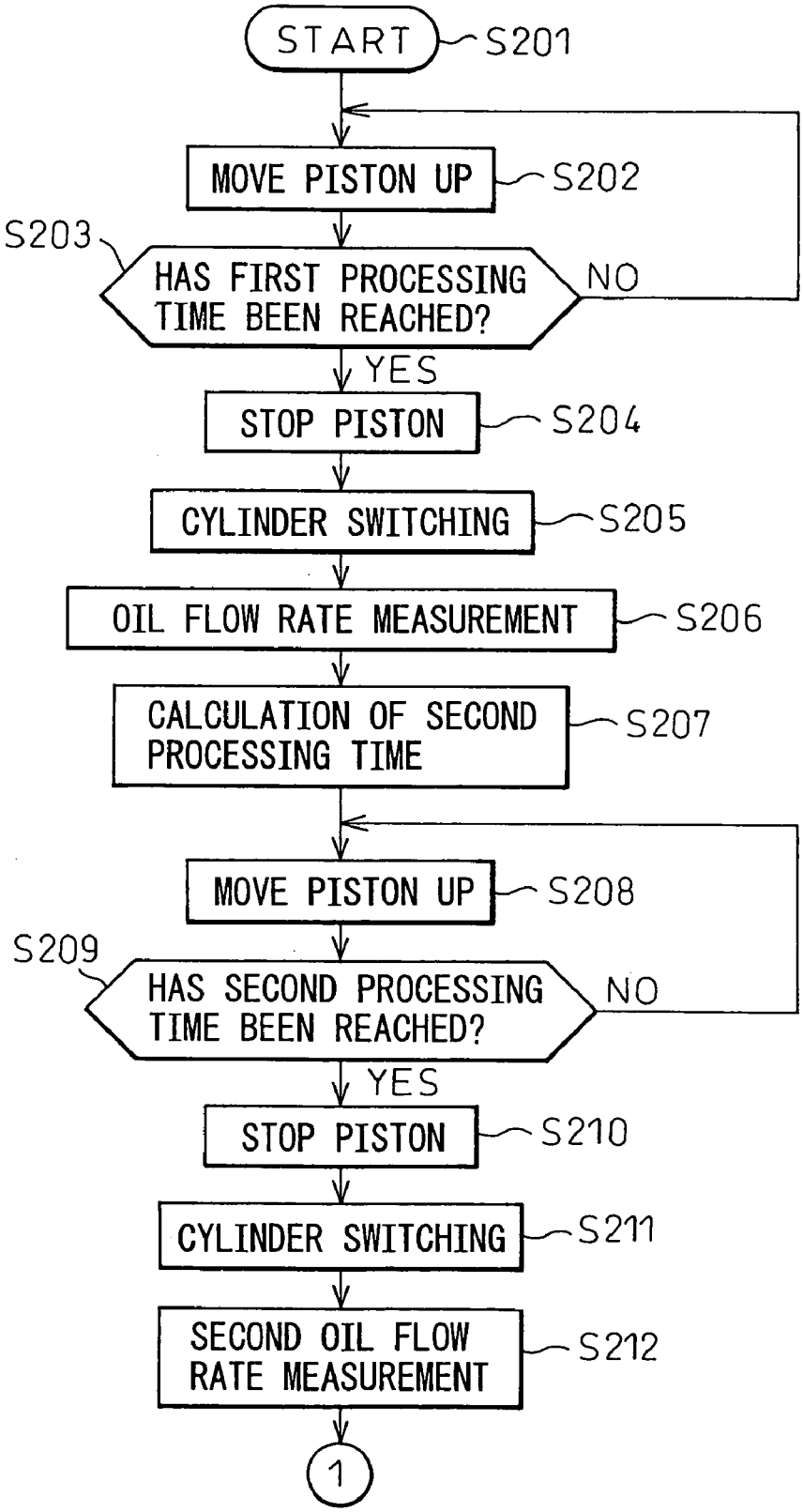
FIG. 18 is a flowchart of a fluid polishing method according to the fifth embodiment of the invention and shows process steps up to a secondary process.
Figure 19:
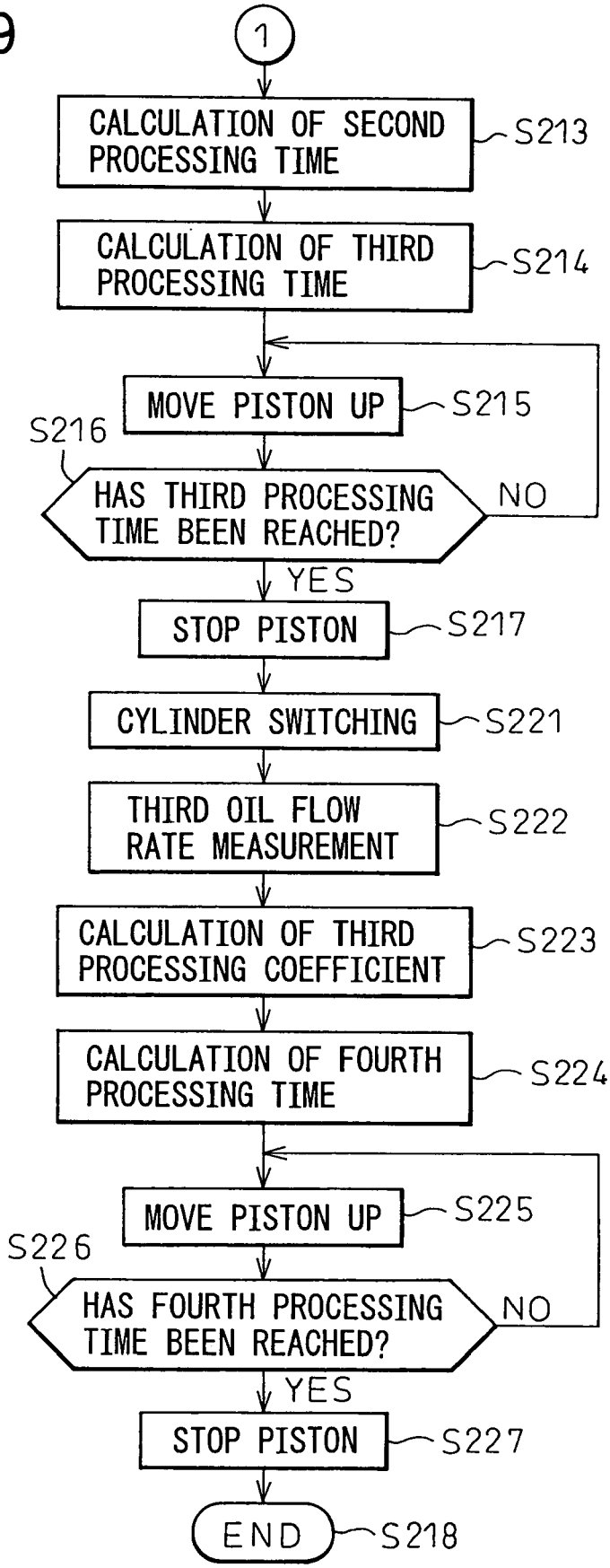
FIG. 19 is a flowchart of the fluid polishing method according to the fifth embodiment of the invention and shows process steps after a finishing process.

FIGS. 17, 18 and 19 respectively show a method of detecting the processing capacity coefficient of the fluid polishing method according to the fifth embodiment of the invention and its flowcharts. Here, the difference from the first embodiment will be described. The flowchart of this embodiment is divided into two drawings. The flowchart of FIG. 9 shows the process from the start to the secondary process and the flowchart of FIG. 19 shows the finishing process. In the fifth embodiment, the procedures from S201 to S212 of the fourth embodiment are the same but the calculation method of the second processing capacity coefficient (Kw2) in S213 is different between the fourth embodiment and the fifth embodiment. The primary and secondary processes are the same but the finishing process is different. In this embodiment, β, a value equivalent to the correction value α, is introduced and the second processing capacity coefficient (Kw2) is given by Kw2=Kw+β. Here, Kw=(Q2−Q1)/T1. The value β is set to a value approximate to a one-way amplitude of variance of the mean value of the past first processing capacity coefficients (Kw), for example, in the same way as α. The third processing time (T2) is calculated on the second processing capacity coefficient Kw2 in S214 (T2=(Q5−Q2)/Kw2) (see FIG. 17). When β is set in this way, the target processing value is not reached by the processing for the third processing time T2.

The flow further proceeds to Step 215 (S215), in which the piston 6*a* is moved up and the slurry 7 is supplied to the orifice 5. When the arrival at the third processing time T2 is detected in Step 216 (S216), the piston 6*a* is stopped in Step 217 (S217) and the cylinder is switched in Step 221 (S221) in the same way as in S205 and S211. In Step 222 (S222), the third oil flow rate (Q3) is measured (see FIG. 17) and the third processing capacity coefficient (Ks) is calculated in Step 223 (S223). The calculation method of Ks is as follows. The gradient of an approximation line (thick solid line in FIG. 17) is determined by the method of least squares from the three points of Q1 and T0, Q2 and T1(T0+T1) and Q3 and T2(T0+T1+T2) and this is set as Ks. In Step 224 (S224), the line is extended at the gradient Ks from Q3 as shown in FIG. 17 to determine the fourth processing time (T3) (T3=(Qf−Q3)/Ks). In this explanation, Ks is determined by the method of least squares but Ks may be determined by known mathematical methods that performs extrapolation from the three points described above.

In Step 225 (S225), the piston 6*b* moves up and the slurry 7 is caused to flow to the orifice 5. In Step 226 (S226), whether or not the fourth processing time (T3) is reached is checked and the processing is finished. (Step 218 (S218)). In the finish processing step (from S213 to S227) in the fifth embodiment, Steps from S213 to S222 are the first stage and Steps from S223 to S227 are the second stage.

Next, the functions and operations of the embodiment described above will be explained.

The fluid polishing method and the apparatus for the method according to the fourth embodiment of the invention provide the following effects.

To improve the accuracy of the processing time by the method of estimating the processing time on the basis of the past statistical amounts in the fluid polishing processing, the processing capacity coefficient is calculated from the processing condition of the fine aperture of the orifice during the processing, and the processing time is decided from this coefficient. Consequently, the processing accuracy of the fine aperture of the orifice is improved.

The fluid polishing method and the apparatus for the method according to the fifth embodiment of the invention provide the following effects.

There is the possibility that processing accuracy can be improved much more than in the fourth embodiment.

In the embodiments described above or shown in the accompanying drawings, the feeding apparatus for supplying the slurry to the orifice as the work is the cylinder that is the plunger type pump. However, the feeding apparatus may be a known pump or fluid feeding apparatus other than the plunger type pump. Though two slurry feeding apparatuses are provided, one or at least three feeding apparatuses may be provided.

The foregoing embodiments represent the example where the invention is applied to the processing of the orifice for the diesel engine common rail injector. However, the invention is not particularly limited thereto and may be applied to the processing of other orifices or the processing of fine apertures such as the tip of a fuel injector, the jet aperture of a carburetor, orifices for regulating a fluid flow rate, the jet nozzles of printers, and so forth, as described already.

The embodiments given above merely represent preferred examples of the invention but in no way limit the invention. In other words, the invention is defined by only the subject matters described in the Scope of Claim for Patent, and can be executed in other forms or embodiments.

While the invention has been described by reference to specific embodiments chosen for purposes of illustration, it should be apparent that numerous modifications could be made thereto, by those skilled in the art, without departing from the basic concept and scope of the invention.

The invention claimed is:

1. A fluid polishing method for polishing and processing a fine aperture in a work by supplying slurry as a polishing fluid to said work by a feeding apparatus, comprising a primary process, a secondary process and a finishing process, wherein:

in said primary process, said slurry is supplied until a slurry feed flow rate from said feeding apparatus increases to a predetermined value smaller than a predetermined slurry flow rate necessary for processing said fine aperture, said feeding apparatus is then stopped to stop the feed of said slurry, an operation fluid is caused to flow to the fine aperture of said work and a first operation fluid flow rate (Q1) is measured;

in said second process, a second processing time (T1) not reaching a target processing is calculated on the basis of said first operation fluid flow rate (Q1), said slurry is supplied for said second processing time (T1) to execute polishing, said feeding apparatus is stopped when said second processing time (T1) is reached to stop the feed of said slurry, said operation fluid is caused to flow to the fine aperture of said work and a second operation fluid flow rate (Q2) is measured;

in said finishing process, a target third processing time (T2) is calculated on the basis of said second operation fluid flow rate (Q2), said slurry is supplied for said target third processing time (T2) to execute polishing, said feeding apparatus is stopped when the processing time reaches said third processing time (T2) to stop the feed of said slurry and processing;

the processing time (T1, T2) in each of said secondary and finishing processes is determined by setting a processing capacity coefficient (K); and said processing capacity coefficient (K) is a function (K=f (x), x=dQ/T) of a ratio (dQ/T) of an increment amount (dQ), of the operation fluid flow rates during processing, to said processing time (T1, T2).

2. A fluid polishing method according to claim 1, wherein the supply of said slurry, until the slurry supply flow rate from the feeder increases to about a predetermined value smaller than a predetermined slurry flow rate necessary for processing a target fine aperture in said primary process, is materialized by supplying said slurry for a first processing time (T0) that is decided from data of past fluid polishing and is reliably smaller than a processing time necessary for processing the target fine aperture.

3. A fluid polishing method according to claim 2, wherein said first processing time (T0) is a time exceeding an unstable region in an initial stage of fluid polishing affected by the condition of said slurry or by the shape of said work.

4. A fluid polishing method according to claim 1, wherein said second processing time (T1) in said secondary process is calculated from a formula $$T1=(Qf-Q1)/\text{first processing capacity coefficient:}$$

where said first processing coefficient=mean processing capacity coefficient (K ave)+correction value (α), Qf is a target operation fluid flow rate, said mean processing capacity coefficient (K ave) is a mean value of processing capacity coefficients (K) determined from past data of fluid polishing, and said correction value (α) is larger than one-way amplitude (3σ) of variance of the past data of said processing capacity coefficient (K).

5. A fluid polishing method according to claim 4, wherein said third processing time (T2) is calculated from equation (2):

$$T2=(Qf-Q2)/\text{second processing capacity coefficient } (Kw),$$

and said second processing capacity coefficient (Kw) is calculated from equation (3):

$$Kw=(Q2-Q1)/T1 \quad (3).$$

6. A fluid polishing method according to claim 1, wherein said finishing process includes a first stage and a second stage;

in said first stage, a third processing time (T2) not reaching a target processing is calculated on the basis of said second operation fluid flow rate (Q2), polishing is carried out by supplying said slurry for said third processing time (T2), said feeding apparatus is stopped when the processing time reaches said third processing time (T2) and said operation fluid is caused to flow through said fine aperture of said work to measure a third operation fluid flow rate (Q3); and in said second stage, a target fourth processing time (T3) is calculated on the basis of said third operation fluid flow rate (Q3), said slurry is supplied for said fourth processing time (T3) to execute polishing, and when the processing time reaches said fourth processing time (T3), said feeding apparatus is stopped to stop the supply of said slurry and processing is finished.

7. A fluid polishing method according to claim 6, wherein, in said first stage, said third processing time (T2) is calculated from equation (4):

T2=(Q2−Q1)/second processing coefficient (Kw2); where said second processing capacity coefficient (Kw2) =mean value of first processing capacity coefficients+correction value (β), a mean value of said first processing capacity coefficients is a mean value of said first processing capacity coefficients determined from past data of fluid polishing, and said correction value (β) is a value larger than one-way amplitude of variance of said past data of said first processing capacity coefficient;

and in said second stage, said fourth processing time (T3) is calculated by mathematical extrapolation by using three measurement values formed from said first, second and third operation fluid flow rates measured (Q1, Q2, Q3) and from said first, second and third processing times (T0, T1, T2) corresponding to the respective flow rates.

8. A fluid polishing method according to claim 7, wherein said mathematical extrapolation method is the method of least squares.

9. A fluid polishing method according to claim 1, wherein the feed pressure of said slurry, from said feeding apparatus, is kept constant.

10. A fluid polishing method according to claim 1, wherein said work is a fine aperture of a fuel injector for a diesel engine.

* * * * *